US009993906B1

(12) United States Patent
Berry et al.

(10) Patent No.: US 9,993,906 B1
(45) Date of Patent: Jun. 12, 2018

(54) VIBRATORY TUMBLER

(71) Applicants: Gilbert Russell Berry, New Harmony, UT (US); Tony James Berry, St. George, UT (US); Richard Douglas Zitting, New Harmony, UT (US)

(72) Inventors: Gilbert Russell Berry, New Harmony, UT (US); Tony James Berry, St. George, UT (US); Richard Douglas Zitting, New Harmony, UT (US)

(73) Assignee: Berry's Manufacturing of Utah, Inc., St. George, UT (US)

( * ) Notice: Subject to any disclaimer, the term of this patent is extended or adjusted under 35 U.S.C. 154(b) by 133 days.

(21) Appl. No.: 15/001,186

(22) Filed: Jan. 19, 2016

Related U.S. Application Data

(60) Provisional application No. 62/105,181, filed on Jan. 19, 2015.

(51) Int. Cl.
*B24B 31/00* (2006.01)
*B24B 31/073* (2006.01)

(52) U.S. Cl.
CPC ..... *B24B 31/073* (2013.01)

(58) Field of Classification Search
CPC ..... B24B 31/064; B24B 31/073
See application file for complete search history.

(56) References Cited

U.S. PATENT DOCUMENTS 2,284,671 A * 6/1942 Meinzer ..... B06B 1/16 134/156
3,268,177 A * 8/1966 McKibben ..... B02C 17/14 241/175
3,484,998 A * 12/1969 Racine ..... B24B 31/073 451/327
3,877,178 A * 4/1975 Campanelli ..... B24B 31/073 366/111
5,036,623 A 8/1991 Alonzo
5,613,902 A 3/1997 Didion
5,733,172 A 3/1998 Nishimura
5,743,790 A 4/1998 Trahan
5,779,527 A 7/1998 Maebashi
5,803,800 A 9/1998 Kobayashi
6,080,052 A 6/2000 Renter
(Continued)

OTHER PUBLICATIONS http://suburbansdomain.blogspot.com/2010/02/cabelasberrys-tumber-review.html.

*Primary Examiner* — Timothy V Eley
(74) *Attorney, Agent, or Firm* — Jones Waldo Holbrook & McDonough, PC; Brent T. Winder

(57) ABSTRACT

A vibratory tumbler. The vibratory tumbler includes a bowl having one or more engagement hooks and a latching hook; a base; and a connection platform coupled to the base and removably coupled to the bowl. The connection platform further comprises a vibration source; one or more openings capable of engaging the one or more engagement hooks; and a locking mechanism capable of engaging the latching hook. The locking mechanism can further comprise a latching opening capable of receiving the latching hook; a spring clip substantially within the latching opening and capable of engaging the latching hook; and a locking lever rotatably coupled to the spring clip whereby the spring clip engages the latching hook when the locking lever is in a locked position and releases the latching hook when the locking lever is in an unlocked position.

19 Claims, 25 Drawing Sheets

(56) References Cited

U.S. PATENT DOCUMENTS

| | | | |
|---|---|---|---|
| 6,210,258 | B1 | 4/2001 | Malkin |
| 6,261,154 | B1 | 7/2001 | McEneny |
| 6,277,011 | B1 | 8/2001 | Moreillon |
| 6,328,639 | B1 | 12/2001 | Pujol |
| 6,350,189 | B1 | 2/2002 | Tanaka |
| 6,379,233 | B1 | 4/2002 | Kobayashi |
| 6,431,955 | B1 | 8/2002 | Toschi |
| 6,464,565 | B1 | 10/2002 | Audet |
| 6,575,814 | B1 | 6/2003 | Ayyagari |
| 6,585,577 | B1 | 7/2003 | Trahan |
| 6,599,176 | B2 | 7/2003 | Hoffman |
| 6,618,890 | B2 | 9/2003 | Muhr-Sweeney |
| 6,656,027 | B2 | 12/2003 | Dietrich |
| 6,682,401 | B2 | 1/2004 | Kobayashi |
| 6,682,410 | B2 | 1/2004 | Fujishiro |
| 6,688,952 | B2 | 2/2004 | Bagdasarian |
| 6,733,374 | B2 | 5/2004 | Gegenheimer |
| 6,733,375 | B2 | 5/2004 | Hoffman |
| 6,808,439 | B2 | 10/2004 | Carpenter |
| 6,814,654 | B2 | 11/2004 | Rolfi |
| 6,843,260 | B2 | 1/2005 | Trahan |
| 6,875,081 | B2 | 4/2005 | Hoffman |
| 6,899,605 | B1 | 5/2005 | Lutz |
| 6,945,852 | B2 | 9/2005 | Bagdasarian |
| 7,056,197 | B2 | 6/2006 | Nishiuchi |
| 7,118,454 | B2 | 10/2006 | Bagdasarian |
| 7,128,639 | B2 | 10/2006 | Riedle |
| 7,290,304 | B2 | 11/2007 | Muhr-Sweeney |
| 7,404,755 | B2 | 7/2008 | Gebhart |
| 7,674,155 | B2 | 3/2010 | Gebhart |
| 7,854,648 | B2 | 12/2010 | Satoh |
| 7,883,396 | B2 | 2/2011 | Potterfield |
| 7,958,900 | B2 | 6/2011 | Bielle |
| 8,241,095 | B2 | 8/2012 | Anderson |
| 8,267,747 | B2 | 9/2012 | Anderson |
| 2007/0107217 | A1* | 5/2007 | Baus ..... B24B 31/064 29/889.1 |
| 2011/0136410 | A1* | 6/2011 | Inatani ..... B24B 31/064 451/36 |

* cited by examiner

VIBRATORY TUMBLER

PRIORITY

This application claims priority to U.S. Provisional Patent Application No. 62/105,181, filed Jan. 19, 2015 which is hereby incorporated by reference for its supporting teachings.

BACKGROUND

Vibratory finishing is a finish manufacturing process used to deburr, radius, descale, burnish, clean and brighten a variety of small objects. Vibratory tumblers are utilized in many industries, including metal fabrication and machine shops and are available in many sizes and configurations for use in this finishing process. Small versions of vibratory tumblers suited for the consumer are widely used in the shooting industry to clean and polish bullet casings in preparation for loading and reloading.

A vibratory tumbler typically includes a vibrating base and a bowl, basin or other container (generically referred to herein as a "bowl" though no particular shape requirement is intended) into which the objects being finished are placed along with a finishing medium. An eccentric, rotating weight shakes the bowl in a circular or substantially circular path. This motion causes the entire load—i.e. the objects being finished and the finishing medium—to be lifted up at an angle and then dropped. As the load is falling, the tub returns to an upward position. Thus, an upward and angular force is applied. This force causes a sheering action where the parts and media rub against each other. Vibratory tumblers produce a smooth finish because the media essentially laps the objects being finished. Since the load is moving as a unit, there is no tearing action or unequal forces that tend to bend and distort objects and this method of finishing is safe for even fragile objects.

It is noted that the present invention is not intended to be limited to any particular vibratory tumbler mechanism. The general description of vibratory tumblers given above is for background information only. Numerous other vibratory tumbling mechanisms as would be apparent to one skilled in the art are considered within the scope of the present invention.

One problem with vibratory finishing, whether small scale or large, is removing the items and media from the bowl. Larger commercial tumblers employ a variety of methods, including gates, screens and ramps, to get the parts and media out of the bowl. For small tumblers, a user usually just picks up the entire unit—i.e. the vibration base and the bowl—and the entire contents are dumped out onto a screen or other separating device. Although the entire unit is not always prohibitively heavy, removal of the load is cumbersome and usually results in spilled product and media. It also makes more likely the possibility that the entire unit will be dropped and broken or damaged.

To address this issue, some vibratory tumblers have been equipped with a removable bowl. However, detaching the bowl requires the removal of screws or other similar fasteners that hold the bowl in place while in use. This method of removal is slow and inefficient. Overall, the removal mechanisms are so inconvenient and cumbersome that many users—even if they have a detachable bowl—will simply not bother with it and will just pick up the whole unit and dump out the contents.

Less secure removal mechanisms are also challenging in that a poorly secured bowl can interfere with the tumbling motion making the machine ineffective for its intended purpose. Additionally, having the bowl wobbly can lead to premature damage to the tumbler. Loosely attached bowls also are more likely to become disengaged potentially spilling their contents and are noisy.

Thus, a vibratory tumbler having a secure attachment mechanism that also allows for quick and easy removal of the bowl would be advantageous.

SUMMARY

The present invention in its various embodiments is a vibratory tumbler. The vibratory tumbler includes a bowl having one or more engagement hooks and a latching hook. The engagement hooks and the latching hook can be substantially uniformly spaced apart, but are not required to be. The bowl includes a lid and in some embodiments that lid is dome shaped which helps minimize noise. The bowl can vary in shape, but a substantially annular shape is advantageous in that it allows for maximum capacity and also allows secure fitting of the lid.

The vibratory tumbler includes a connection platform that can be removably secured to the bowl. The connection platform includes a vibration source, one or more openings capable of engaging the one or more engagement hooks and a locking mechanism capable of engaging the latching hook. In certain embodiments, the locking mechanism includes a latching opening capable of receiving the latching hook; a spring clip substantially within the latching opening and capable of engaging the latching hook; and a locking lever rotatably coupled to the spring clip whereby the spring clip engages the latching hook when the locking lever is in a locked position and releases the latching hook when the locking lever is in an unlocked position. The engagement hooks and latching hook can be substantially the same or they can be different. In some embodiments, the engagement and latching hooks are notched; in some embodiments they are substantially solid. One or more compression pads can be included on the connection platform which help to secure the bowl and also minimize noise.

In certain embodiments, the connection platform is coupled to a base through a series of springs. The springs serve to isolate the vibrating motion of the bowl

DETAILED DESCRIPTION OF THE DRAWINGS

Figure 1:
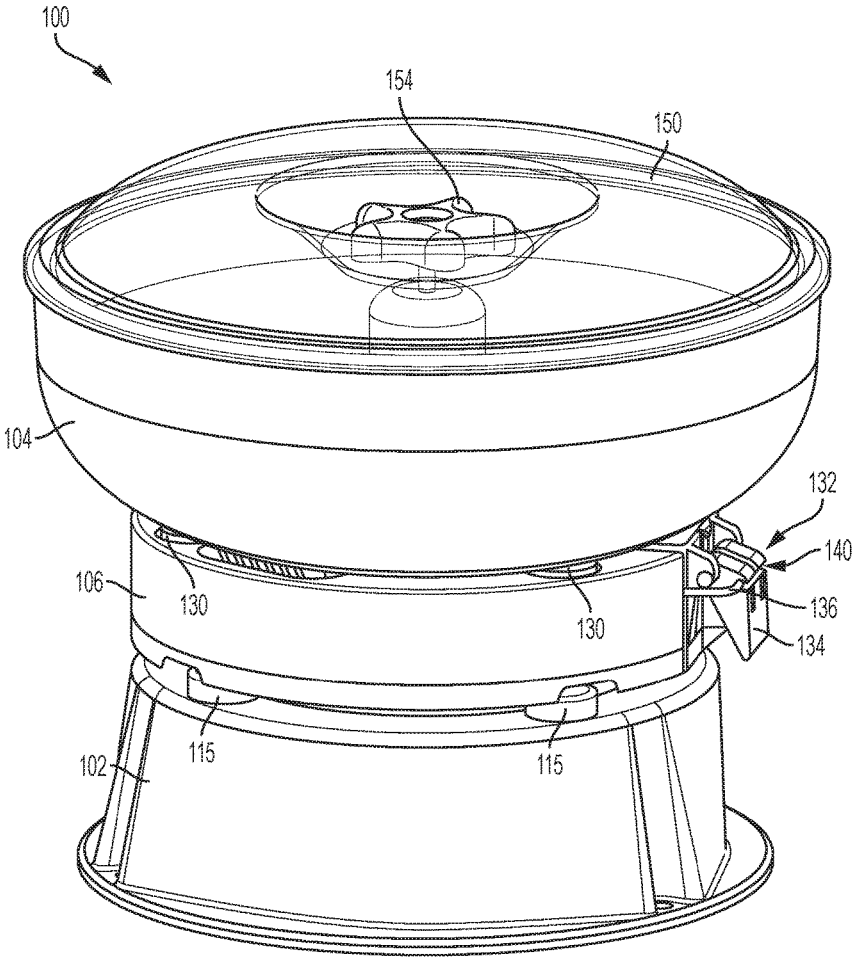
FIG. 1 is a front perspective view of a vibratory tumbler according to one embodiment of the present invention with the locking mechanism in a locked position.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

The present invention in its various embodiments is a vibratory tumbler that includes a removable bowl that can be securely affixed to the base when in use, but that can also be quickly and easily removed when a user desires to empty its contents. In particular, the present invention includes a connection platform having a novel locking mechanism that securely affixes the bowl to the connection platform from substantially every degree of freedom when in use. It also allows for quick and easy removal of the bowl when desired. As illustrated below, the present invention utilizes hooking mechanisms, levers and clips that work in combination to this end.

Prior art tumblers typically include a lidded bowl into which the objects and finishing medium are placed and a vibratory base. The bowl must be secured tightly enough to transfer the energy from the source of the vibrating motion to the bowl during the tumbling process. However, this usually requires a user simply pick up the entire tumbler to remove the bowl's contents.

FIG. 1 depicts an improved tumbler 100 according to one embodiment of the present invention. In this embodiment, the vibratory tumbler 100 similarly includes a bowl 104 and a base 102. It also includes a connection platform 106 to which the vibration mechanism is attached and which features a latch 132 having a locking lever 134 rotatably coupled with a spring clip 136. In this illustration, the locking lever 134 is shown in a down or secured position as would be the case when the tumbler 100 is in operation.

Figure 2:
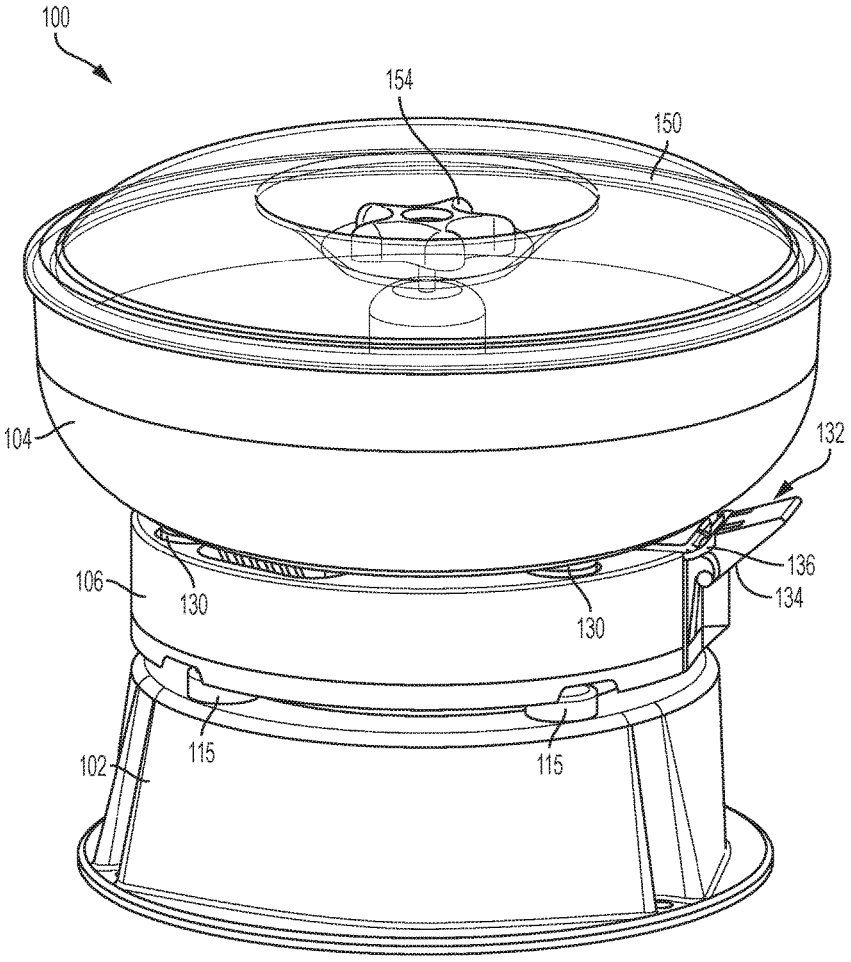
FIG. 2 is a front perspective view of a vibratory tumbler according to one embodiment of the present invention with the locking mechanism in an unlocked position.

FIG. 2 shows the tumbler 100 of FIG. 1 with the lock lever 134 in an up, or bowl 104 removal position as would be the case when either loading the contents of the bowl 104 for finishing or unloading the contents once finishing is completed.

Figure 3:
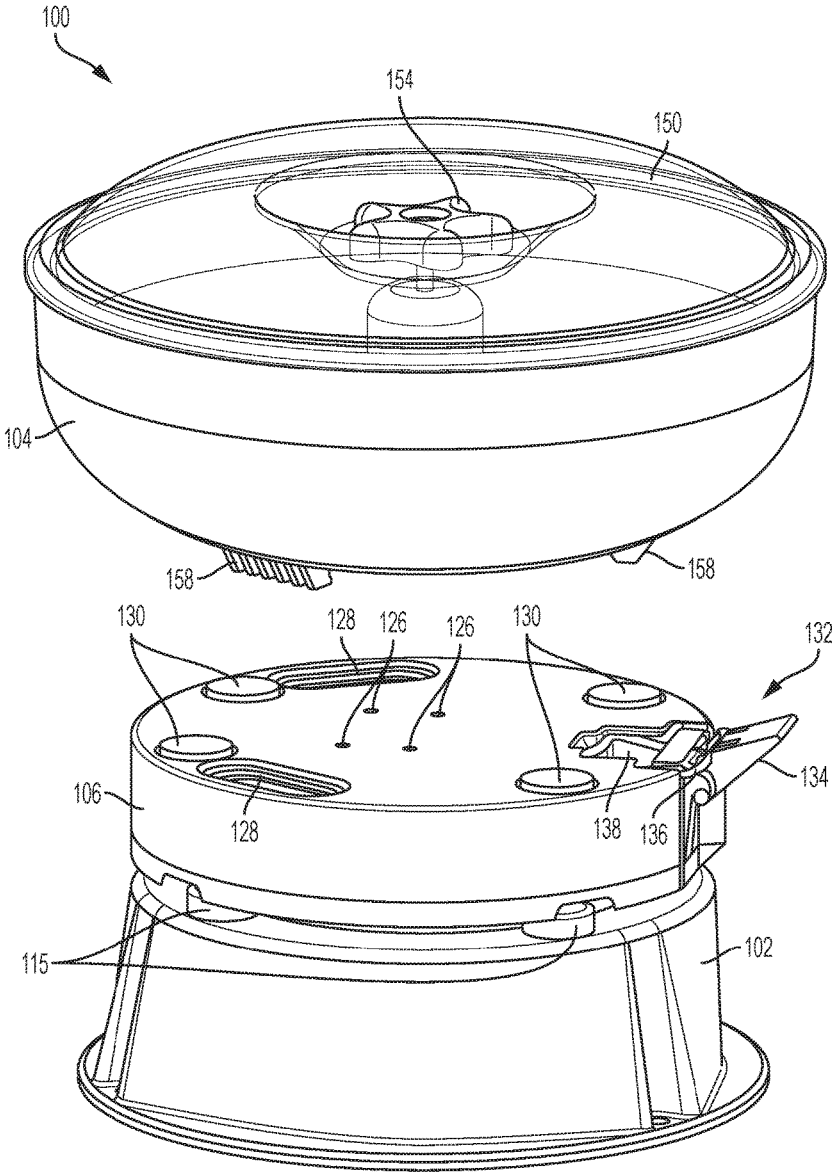
FIG. 3 is a front perspective view of a vibratory tumbler according to one embodiment of the present invention with the locking mechanism in an unlocked position and the bowl removed.
Figure 4:
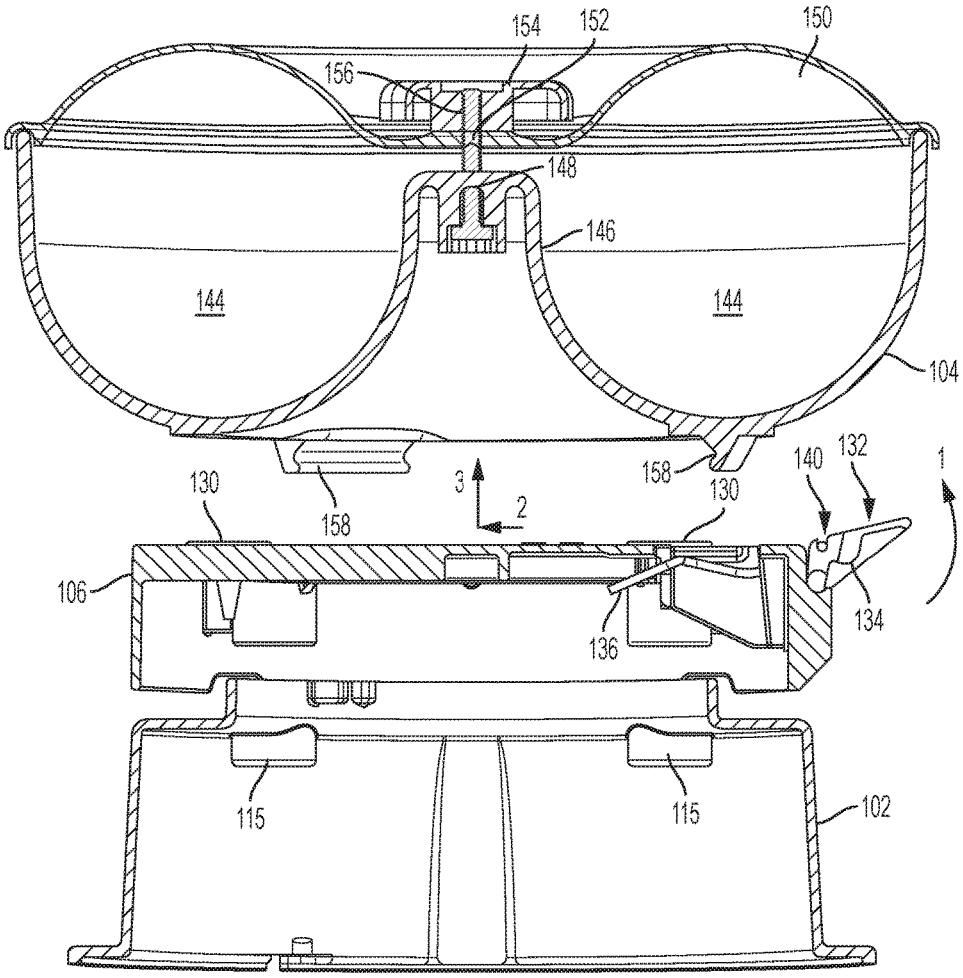
FIG. 4 is a side sectional view of a vibratory tumbler according to one embodiment of the present invention with the locking mechanism in an unlocked position and the bowl removed.

FIGS. 3 and 4 show a vibratory tumbler 100 according to one embodiment of the present invention with the locking lever 134 in an up or bowl 104 removal position and the bowl 104 removed. The hooks 158, bowl engagement openings or slots 128, latching opening 138 and latch 132 as discussed further below can also be seen. FIG. 4 illustrates the unlocking motion with reference numbers 1, 2 and 3 where the locking lever 134 is lifted to an unlocked position (1); the bowl 104 is slid to disengage it from the slots 128 and latching opening 138 (2); and the bowl 104 is then lifted for removal (3).

Figure 5:
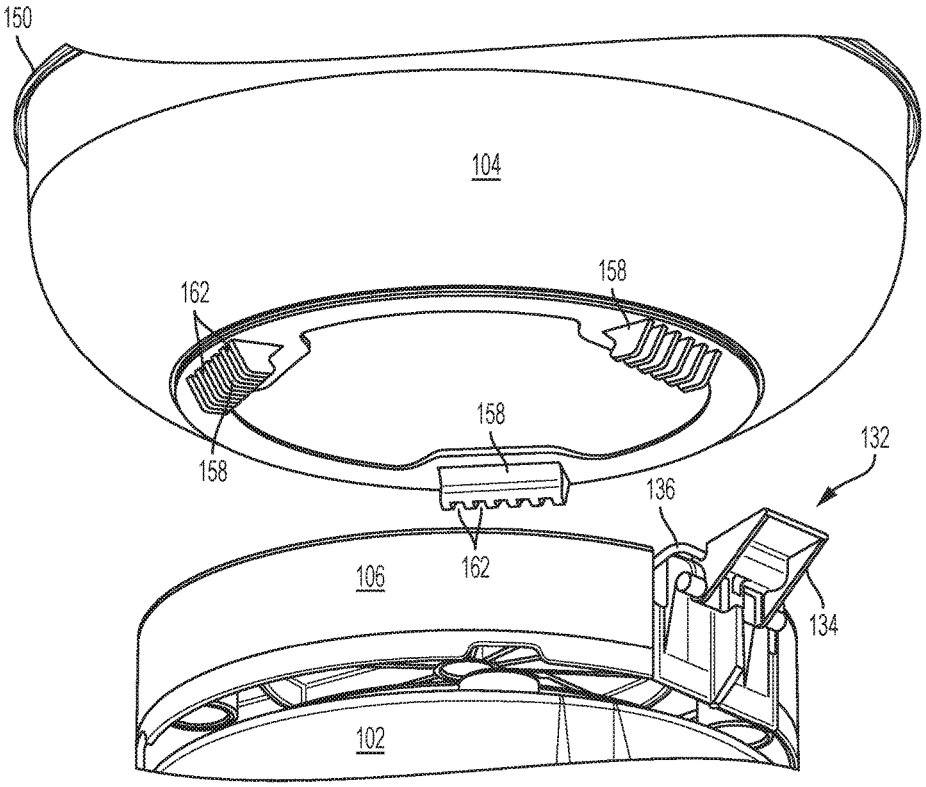
FIG. 5 is a partial bottom perspective view of a vibratory tumbler according to one embodiment of the present invention with the locking mechanism in an unlocked position and the bowl removed.
Figure 6:
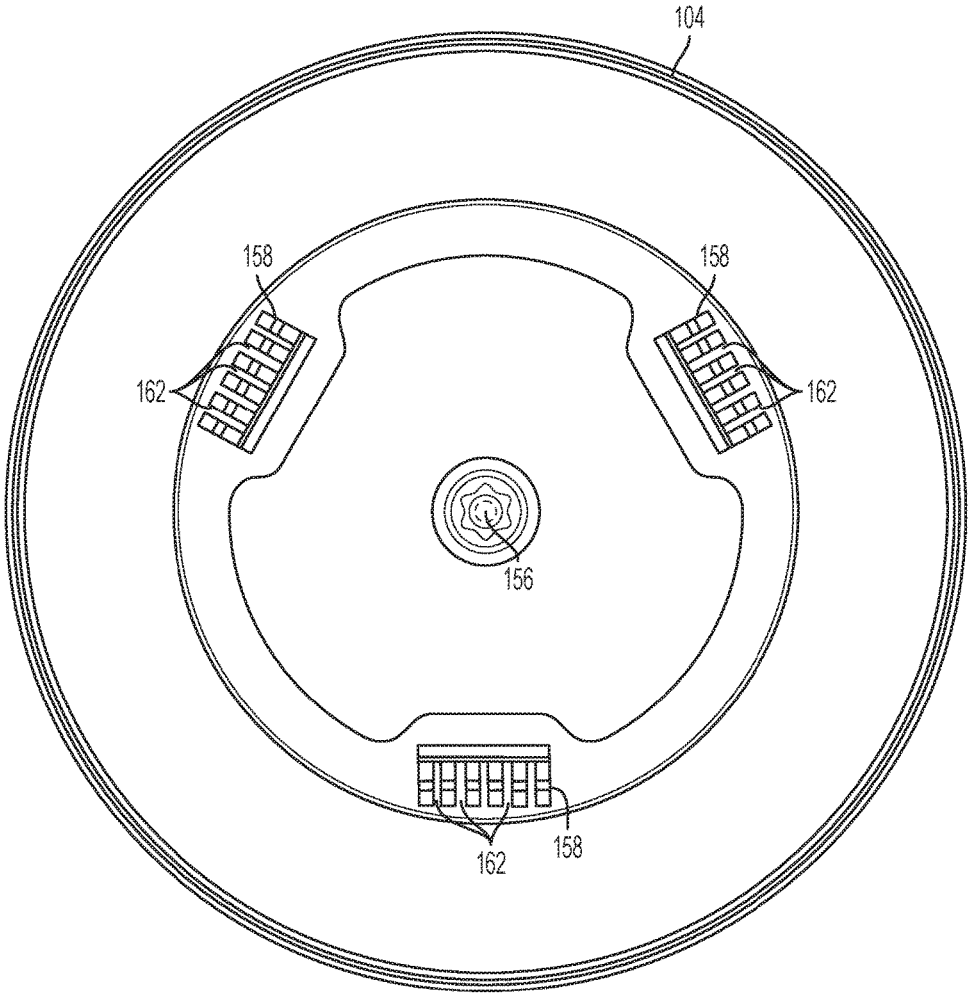
FIG. 6 is a bottom view of a vibratory tumbler bowl according to one embodiment of the present invention.

FIGS. 5 and 6 illustrate the hooks 158 on the underside of the bowl 104 according to one embodiment of the present invention. In operation, one hook will typically serve as a latching hook 159 (e.g. FIG. 17) and the other hooks will serve as slot or opening engagement hooks 160 (e.g. FIG. 13). In some instances the latching hook 159 and slot engagement hooks 160 may be differently configured for these purposes. However, in this embodiment, all three hooks 158 are substantially the same. Uniformity in the hooks 158 allows for flexibility in terms of orienting the bowl 104 on the connection platform 106 and base 102—i.e. it is not necessary that one particular hook 158 line up with the latch 132. It also allows for greater ease and efficiency in manufacturing.

It is also noted that in some of the illustrated embodiments, the hooks 158 are notched 162 which allows for optimal strength with minimum materials. However, in other embodiments, the hooks 158 may not include such notches 162. In other embodiments, the hooks 158 could be narrower. In yet other embodiments, the hooks 158 could be wider. All are considered within the scope of the present invention. Additionally, the term "hooks" is not intended to be solely limited to a rounded side-sectional "J" shape. In some embodiments, it may be advantageous to have hooks that are more angular.

In the presently illustrated embodiment, the bowl 104 includes three hooks 158. However, in certain embodiments, it may be desirable to have more or fewer hooks 158. In the embodiment illustrated below, three hooks 158 are arrayed approximately one hundred and twenty degrees apart. This exact angular orientation of the hooks 158 is not vital, but even positioning allows the bowl 104 to work the same in any orientation and there is no wrong way to put the hooks 158 into the corresponding engagement openings 128, 138.

Figure 7:
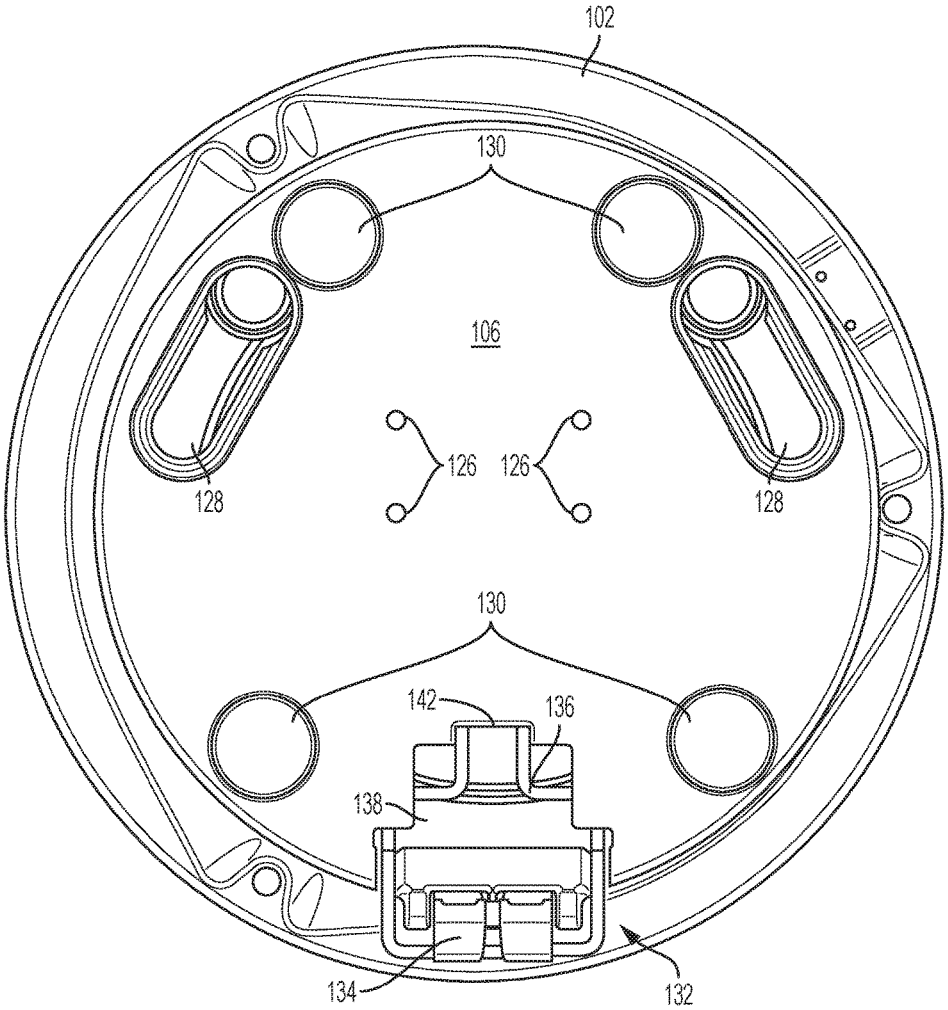
FIG. 7 is a top view of a vibratory tumbler connection platform according to one embodiment of the present invention.
Figure 9:
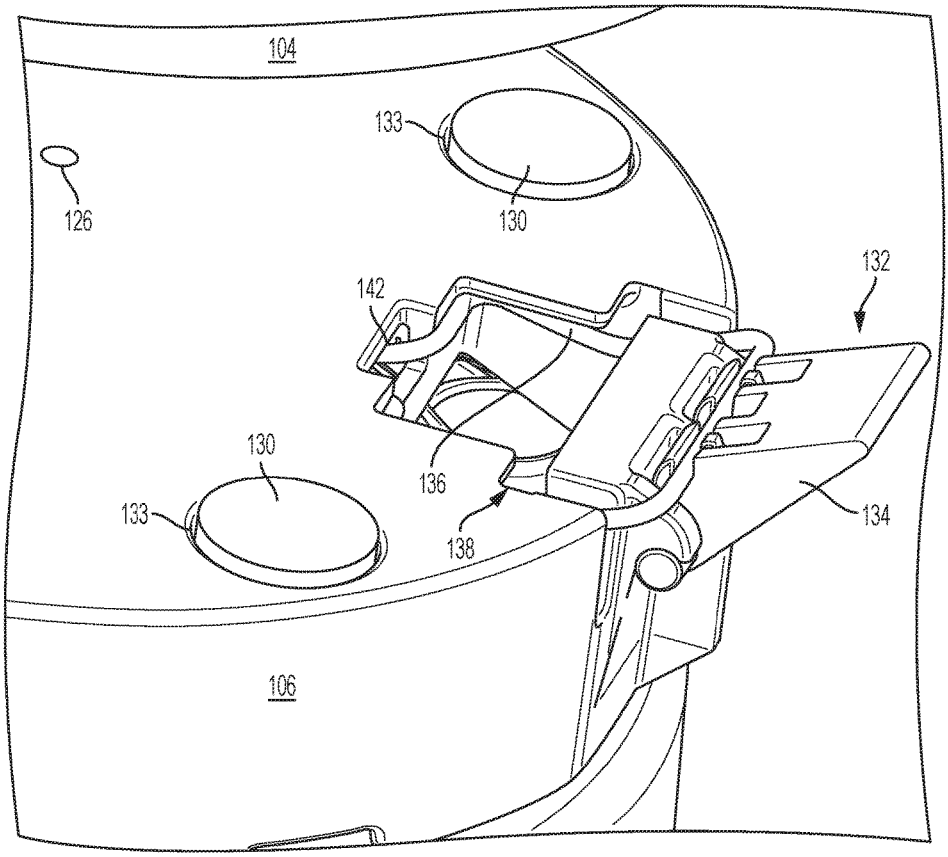
FIG. 9 is a partial top perspective view of a vibratory tumbler connection platform according to one embodiment of the present invention with the locking mechanism in an unlocked position.
Figure 10:
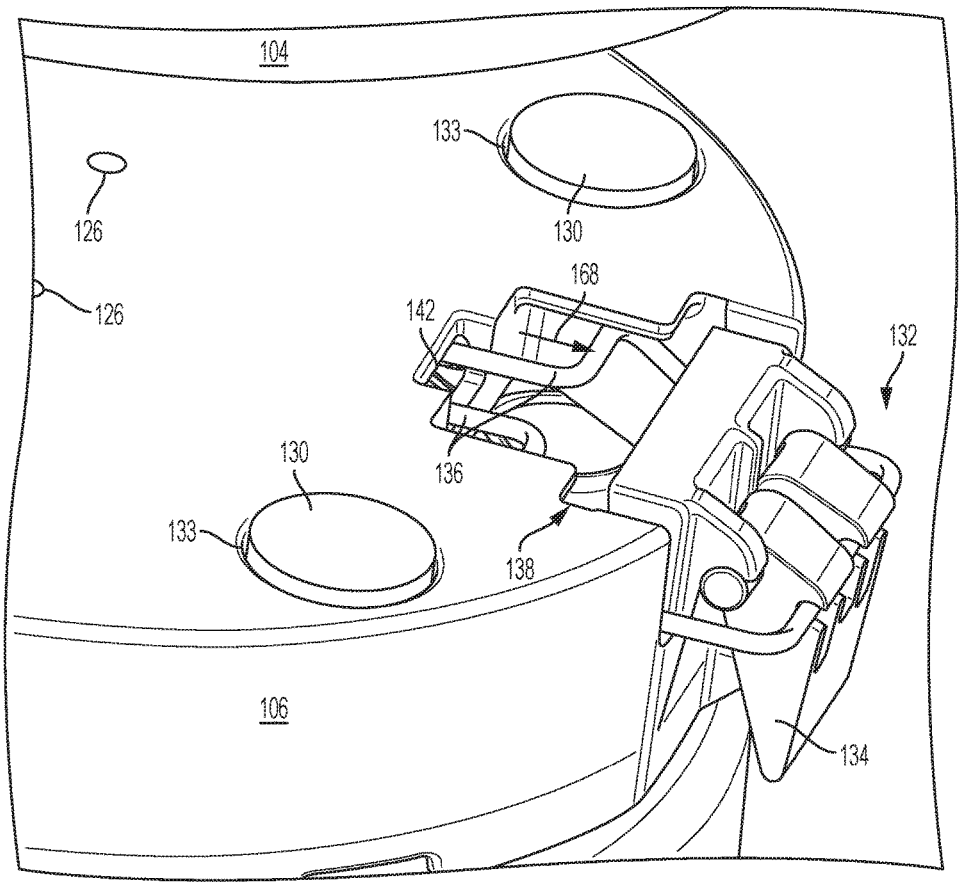
FIG. 10 is a partial top perspective view of a vibratory tumbler connection platform according to one embodiment of the present invention with the locking mechanism in a locked position.

FIG. 7 is a top view of a connection platform 106 of the base 102 showing slots 128 and the latch mechanism 132 and their relative orientation as well as the apertures 126 to which motor, offset weights and fan assembly are attached (FIG. 20), compression pads 130 and opening 142 in connection platform 106 in which the spring clip 136 moves back and forth as the latch 132 is locked and unlocked (see FIGS. 9 and 10).

It is noted that the term "slot" is not intended to be limited to a narrow, elongated opening even though that is how they are generally depicted in the illustrations. As discussed above, the hooks 158 could be a variety of shapes and configurations. Similarly, the slots or openings 128 in connection platform 106 could be other shapes including, but not limited to, substantially oval, substantially rectangular, substantially round or combinations thereof. The exact shape could differ provided the openings 128 are able to engage the hooks 158 as discussed herein. Moreover, as noted with the hooks, in some embodiments it may be desirable to have more or fewer slots or openings 128. In some instances, the number of slots 128 may not exactly match up with the number of hooks 158. For example, in some embodiments the connection platform 106 may include more slots 128 than there are hooks 158.

It is also noted that the connection platform 106 is depicted in the illustrations as a distinct component from the base 102. This is typically the case for ease of manufacture and assembly. However, a distinct base 102 and connection platform 106 is not intended to be a limiting feature as, in certain embodiments, the base 102 could be eliminated. In yet other embodiments, the base 102 and connection platform 106 could comprise multiple component parts or could be a singly manufactured unit.

Figure 8:
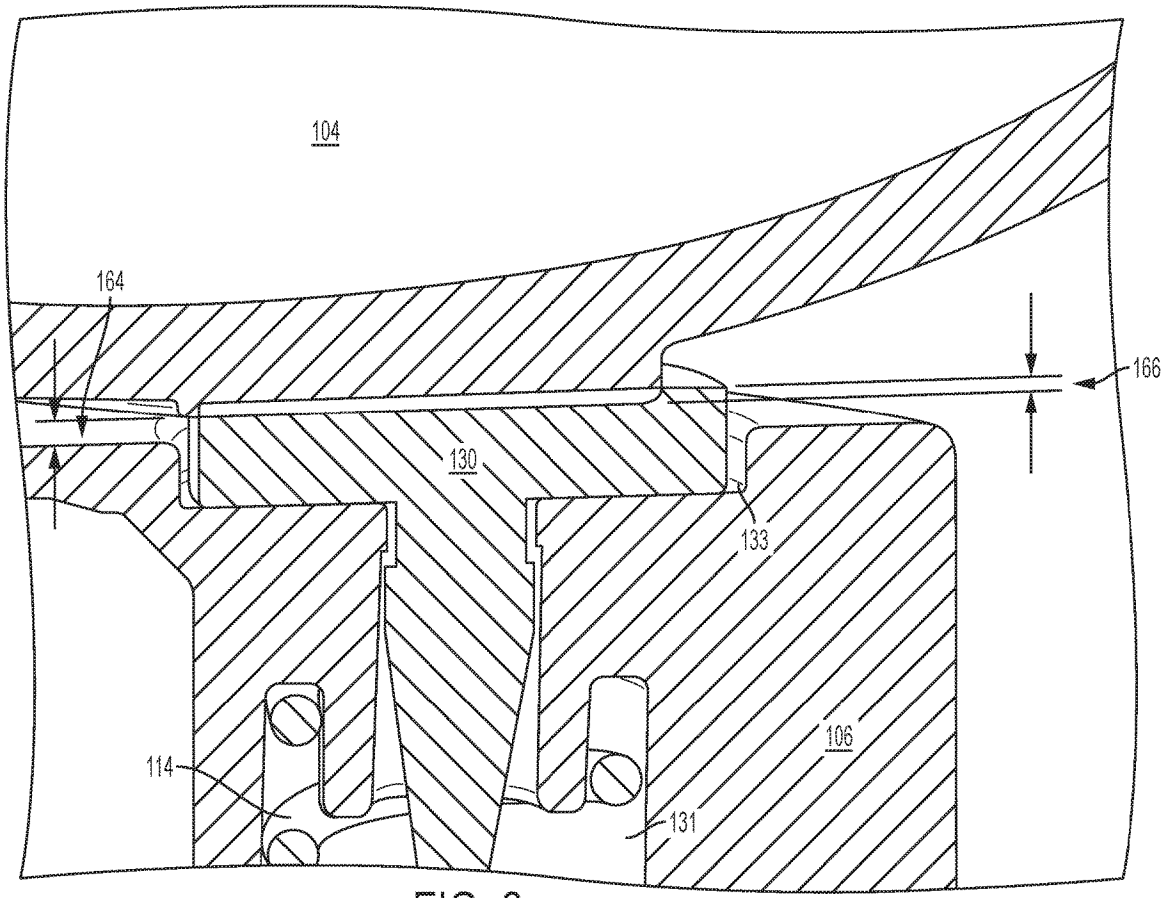
FIG. 8 is a front perspective view of a compression pad according to one embodiment of the present invention.

FIG. 8 depicts the compression 166 of the bumpers or compression pads 130 according to one embodiment of the present invention. Compression pads 130 can be included on the top surface of the connection platform 106 to help secure the bowl and protect it from damage during operation. In this embodiment there are four pads 130, though in certain embodiments more or fewer pads might be used. In some embodiments, it may be desirable to remove the pads 130 altogether. The pads 130, along with the security of the latching and hook system and lid 150 minimize the noise and movement of the tumbler 100 in operation. In particular, when the bowl 104 is set on the pads 130 and then locked in place, the pads 130 are slightly compressed sufficiently to absorb movement and prevent looseness between components that could cause rattling or noise. The pads 130 in this embodiment are polymeric, but they can be made of other materials as would be apparent to one skilled in the art.

FIG. 8 also illustrates the indentations 133 where the compression pads 130 sit. In certain embodiments, the indentations 133 could be shallower or deeper depending on the thickness of the compression pads 130. In certain embodiments, no indentations 133 would be necessary and the pads 130 would sit directly on top of the connection platform 106 top surface. FIG. 8 also illustrates the clearance, depicted at 164, between the bottom side of the bowl 104 and the top surface of connection platform 106—which, again, helps keep components from rubbing together and creating undesired noise.

FIGS. 9 and 10 are another depiction of the top surface of the connection platform 106 with the locking lever 134 in an unlatched position and a latched position respectively. FIG. 10 illustrates the relative movement 168 of the spring clip 136 as the latch 132 is moved to a locked position. In this embodiment, locking lever 134 is shown pivotally connected to the spring clip 136 with an open snap connection 140. However, other connection mechanisms as would be apparent to one skilled in the art could be utilized.

Figure 11:
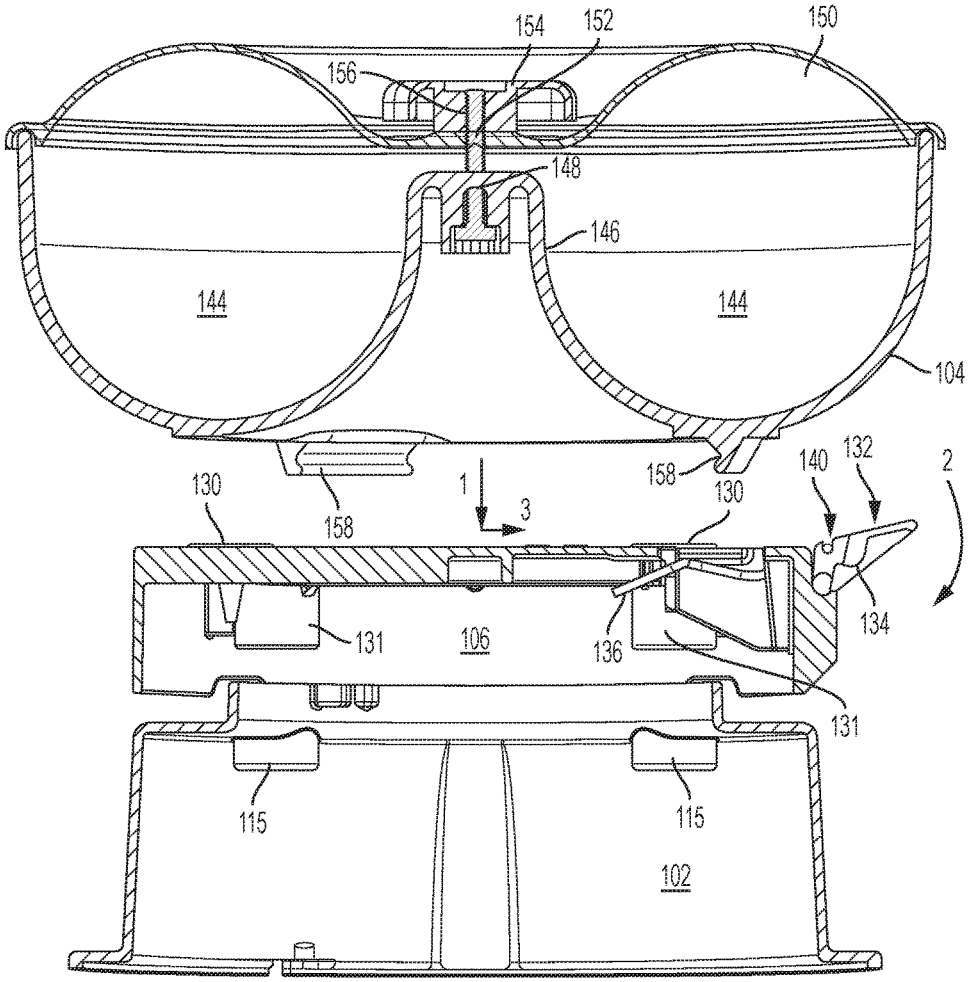
FIG. 11 is a side sectional view of a vibratory tumbler according to one embodiment of the present invention illustrating the bowl locking motion.

FIG. 11 is a side-sectional view of a vibratory tumbler 100 according to one embodiment of the present invention. This illustration depicts the bowl 104 locking motion. Specifically, a user would lower bowl 104 so that hooks 158 corresponded to slots 128 and latch opening 138. This motion is depicted at (1). Locking lever 134 is in an unlocked position at this point. Once bowl 104 is in place, locking lever 134 is switched to a locked position. This motion is depicted at (2). Locking the latch 132 engages one hook 158 with spring clip 136 and pulls the bowl 104 slightly toward the latch 132 seating the hooks 158 into their corresponding slots 128. This motion is depicted at (3).

FIG. 11 also illustrates various features of the bowl 104 according to one embodiment of the present invention. In this embodiment, the bowl includes an annular cavity 144 into which the tumbling medium is placed. The bowl 104 can include a central rise 146 having an opening 148 that corresponds to opening 152 in lid 150 when in place. To secure the lid 150 to the bowl 104, a bolt or other similar fastening mechanism 156 is inserted through openings 148 and 152 and then coupled to threaded knob 154.

Figure 12:
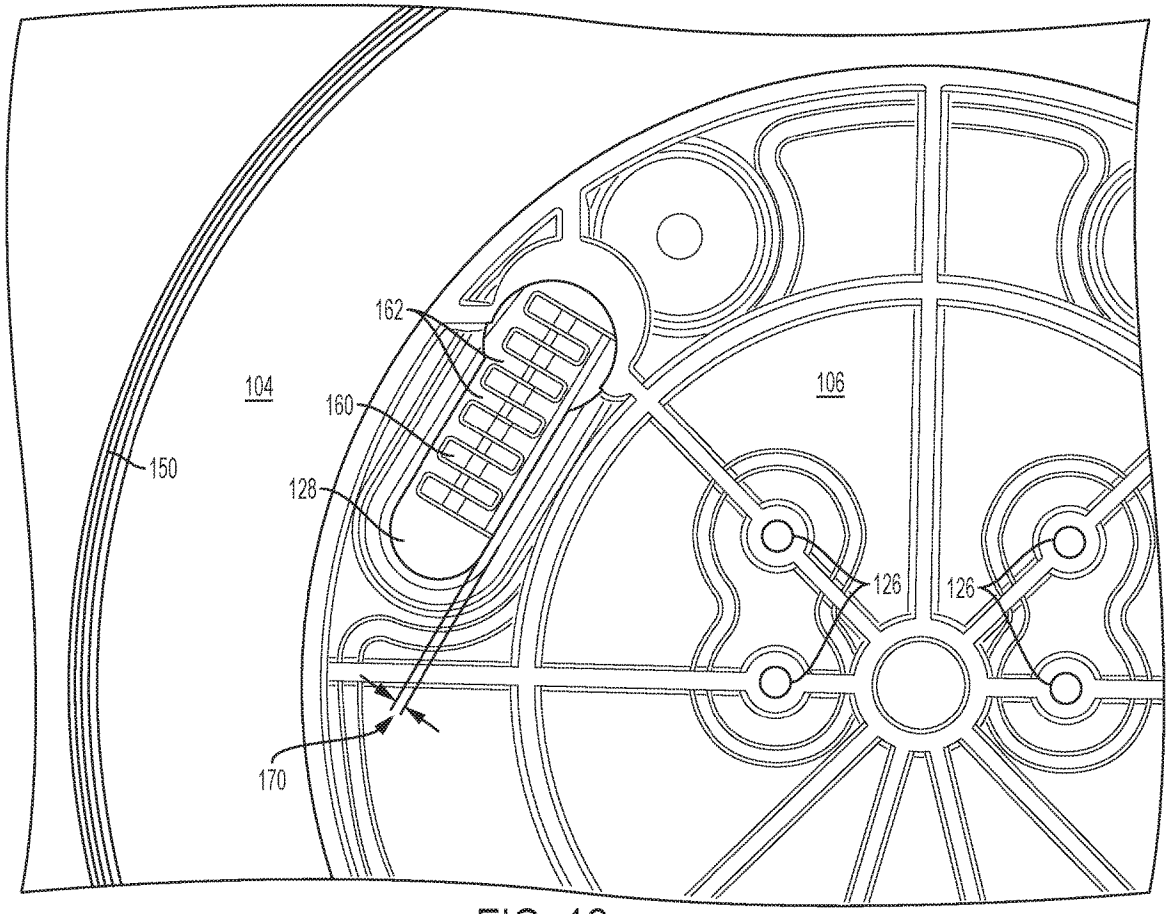
FIG. 12 is an underside view of a connection platform illustrating the pre-connection placement of the bowl according to one embodiment of the present invention.
Figure 13:
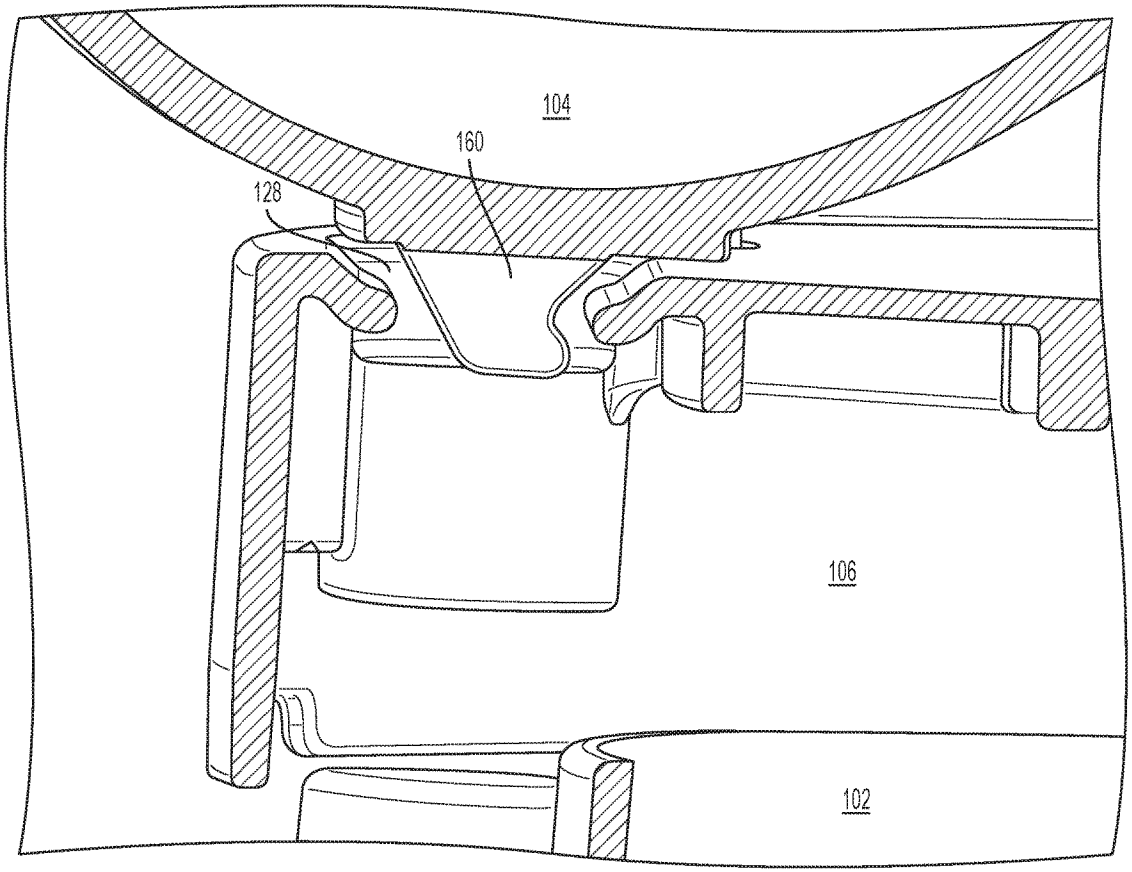
FIG. 13 is a partial side-sectional view of a connection platform according to one embodiment of the present invention illustrating a hook placed in a bowl engagement opening.

FIG. 12 is an underside view showing how hooks 160 and slots 128 are aligned as the bowl 104 is first lowered onto connection platform 106 according to one embodiment of the present invention. The initial distance between the hook 160 and the edge of the slot 128 is depicted at 170. FIG. 13 is a side-sectional view illustrating the hook 160 as it is lowered into slot 128 according to one embodiment of the present invention. In this embodiment, the hook 160 has significant clearance such that it can be easily installed and removed.

Figure 14:
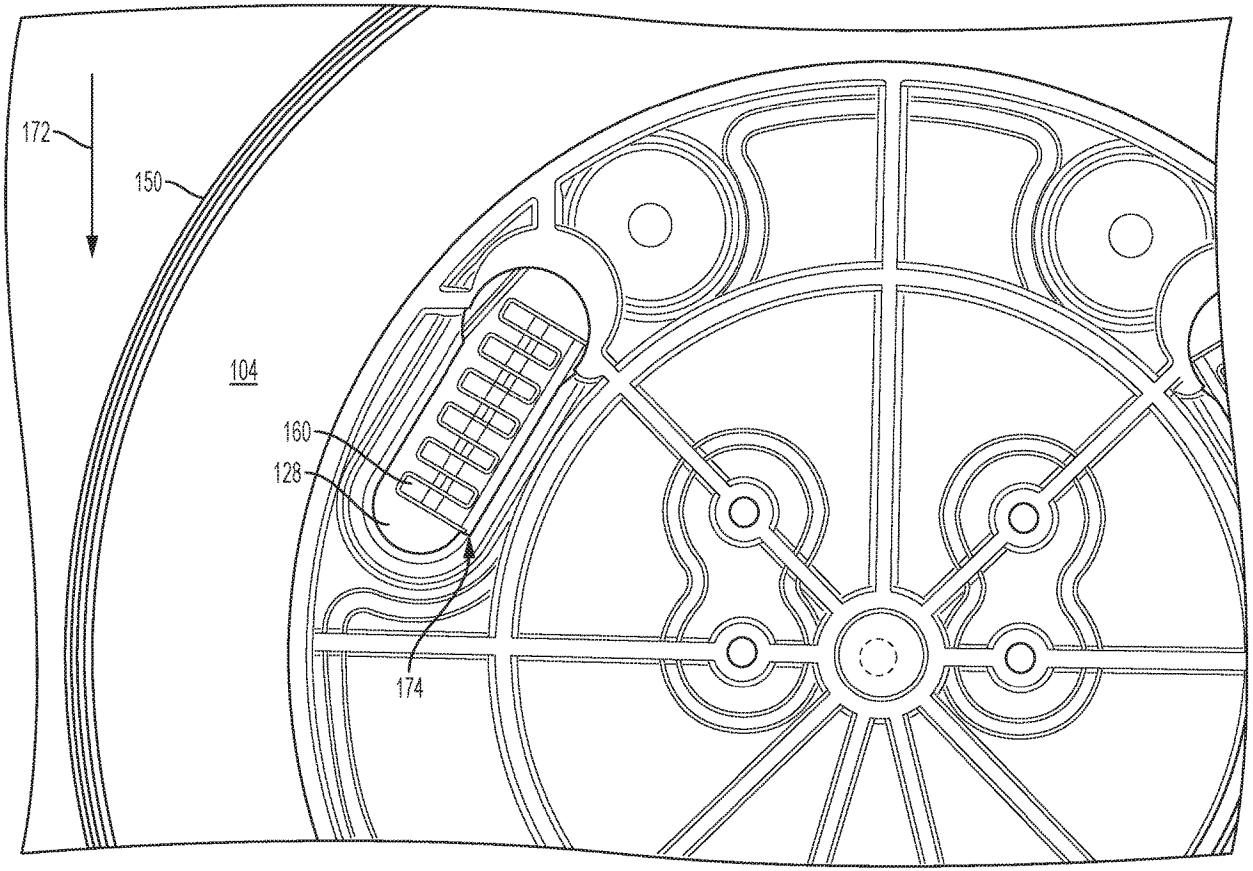
FIG. 14 is a partial underside view of a connection platform illustrating the engagement of the bowl hooks with the corresponding openings in the platform according to one embodiment of the present invention.
Figure 15:
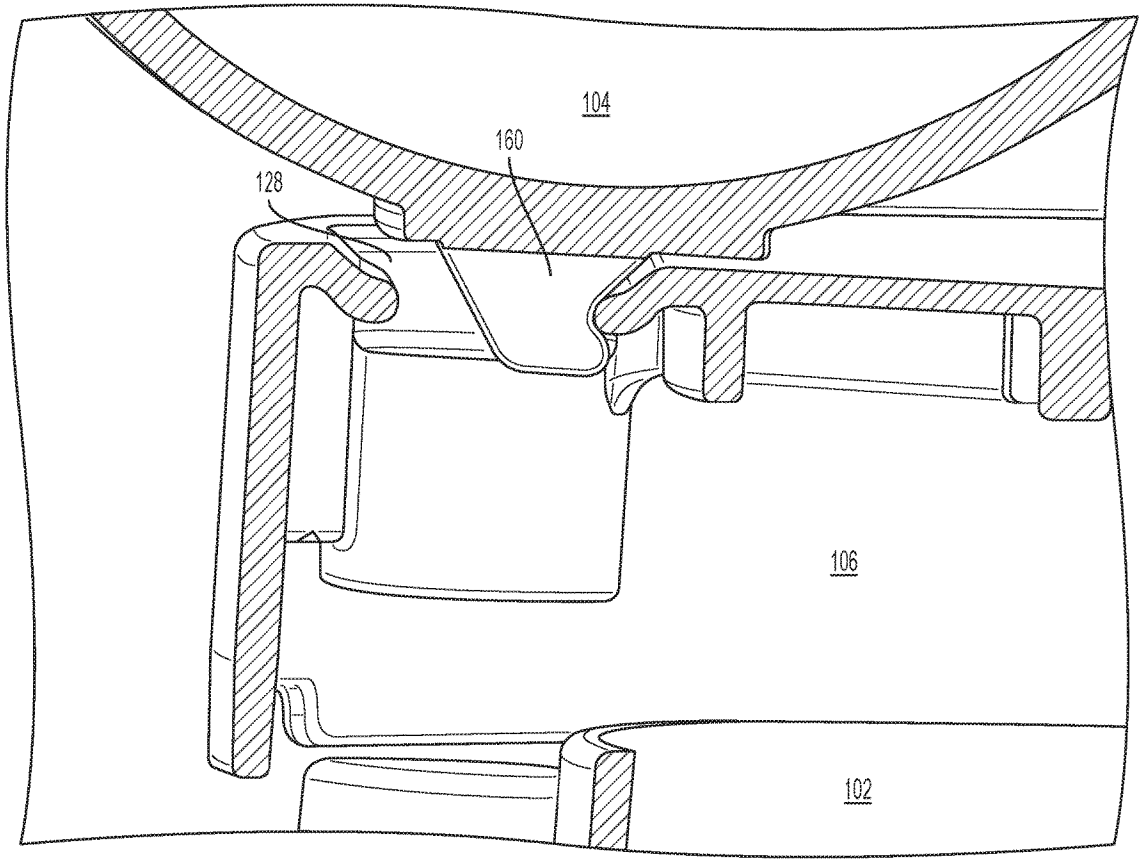
FIG. 15 is a side-sectional view of a connection platform according to one embodiment of the present invention illustrating a hook seated in a bowl engagement opening when the locking mechanism is in a locked position.
Figure 16:
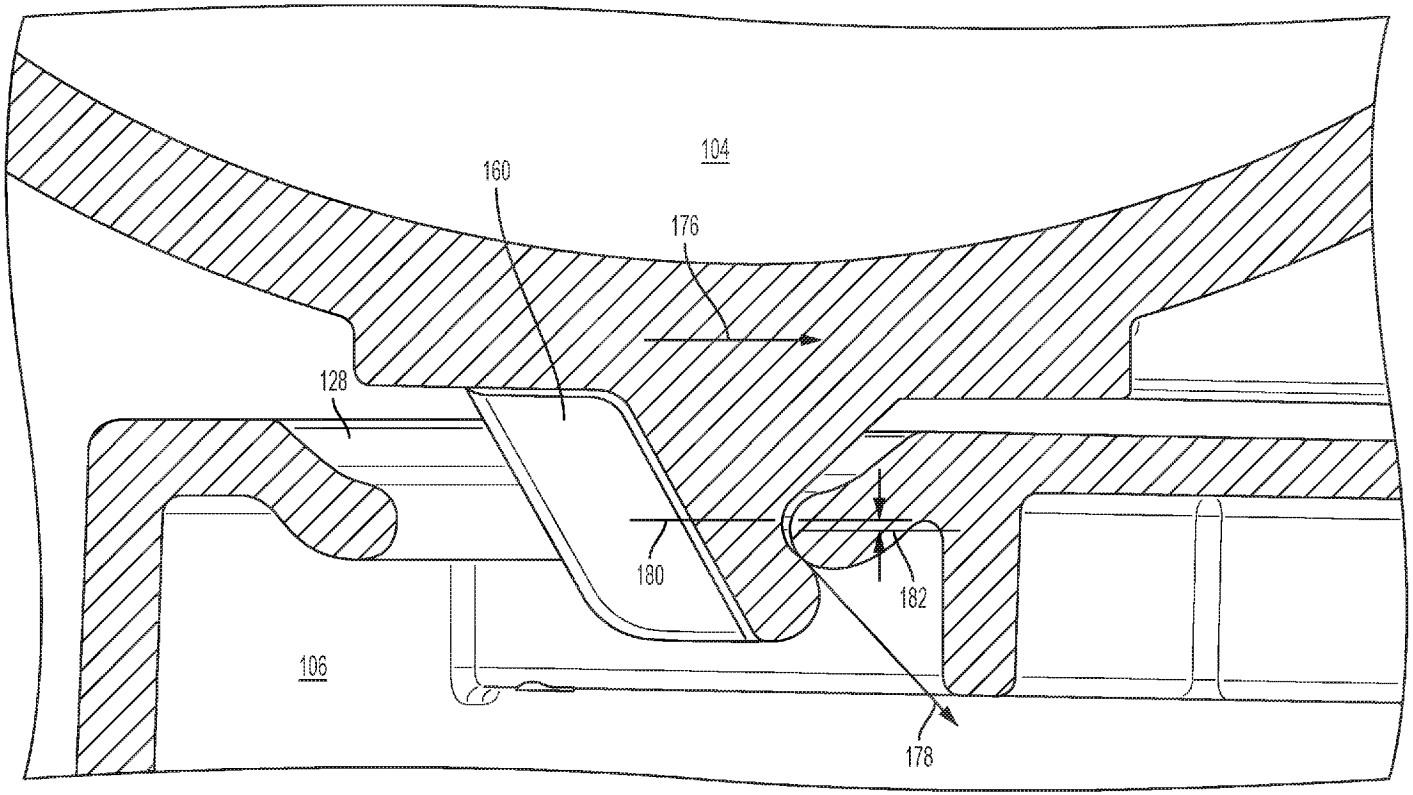
FIG. 16 is a partial side-sectional view of a connection platform according to one embodiment of the present invention illustrating the locking force as a hook is seated in a bowl engagement opening when the locking mechanism is in a locked position.

FIGS. 14-16 illustrate the engagement of the hooks 160 and the slot 128 as the latch 132 is placed in a locked position. Referring to FIG. 14, the directional pull of the bowl 104 by the latch 132 as it is being locked is depicted with arrow 172. As depicted at arrow 174, the relative angle of the hooks 160 and the slots 128 cause the hooks 160 to engage with the slot 128 and thus the platform 106 when pulled toward the latch 132 providing a secure seat for the bowl 104.

As illustrated in FIG. 16, the locking force 176 pulls the substantial center of the hook socket 180 into the substantial center of the platform engagement 182. This seating action creates a downward force depicted at arrow 178. This downward force 178 is necessary to compress the bumpers or compression pads 130. In this embodiment, the hooks 160 are designed slightly shorter to create such a downward vector when the hooks 160 are mated to the connection platform 106 and base 102.

Figure 17:
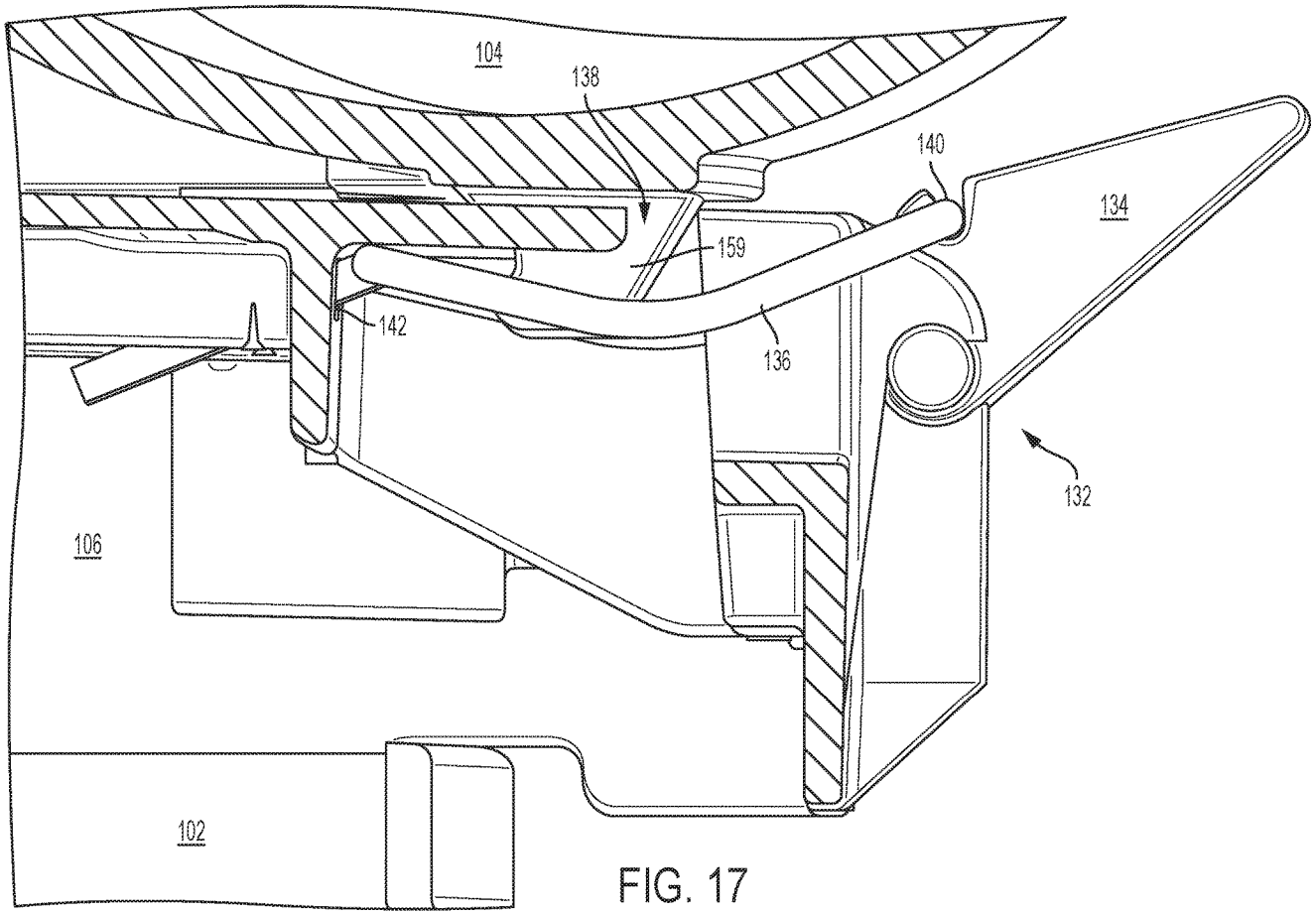
FIG. 17 is a side-sectional view of a locking mechanism according to one embodiment of the present invention with the locking mechanism in an unlocked position.
Figure 18:
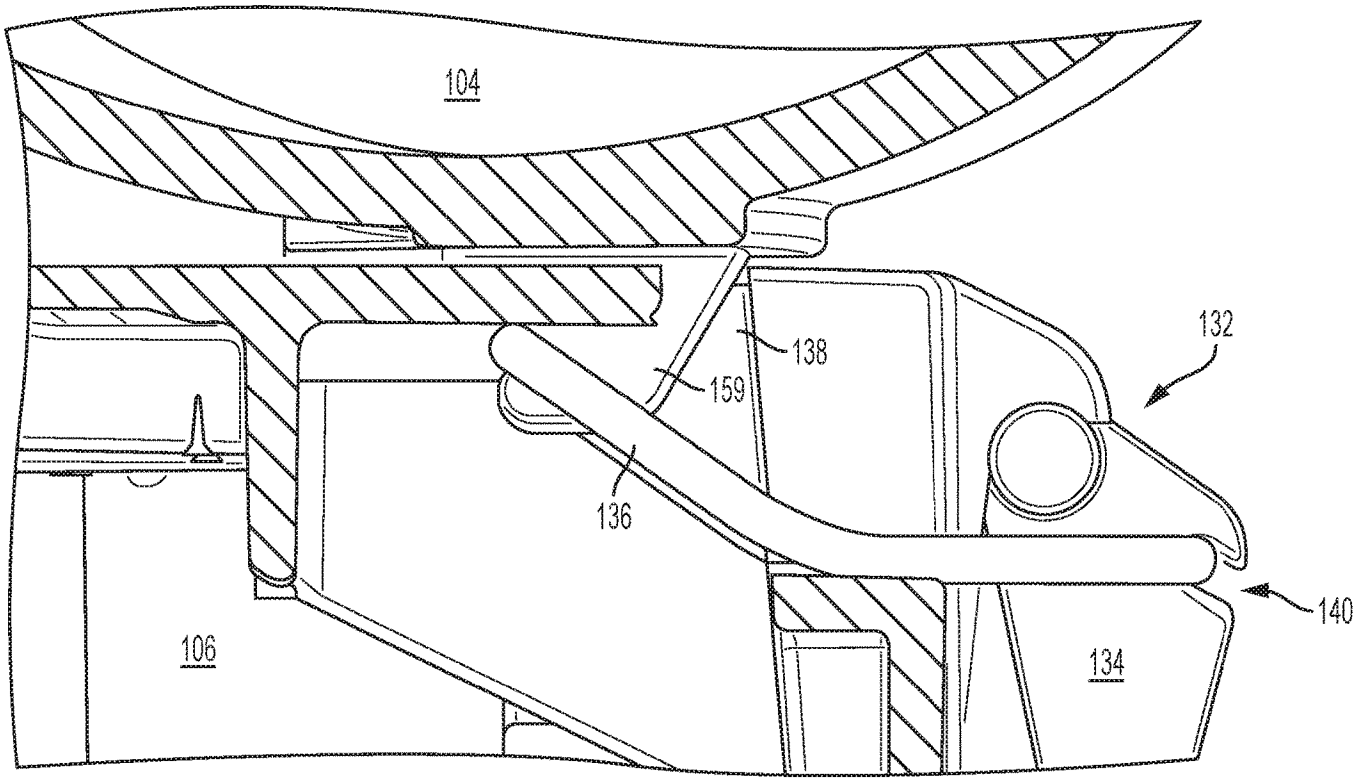
FIG. 18 is a side-sectional view of a locking mechanism according to one embodiment of the present invention with the locking mechanism in a locked position.

FIGS. 17-19, 21-25 further illustrate the operation of the latching mechanism 132 as it works in concert with the hook 160 and slot 128 mechanism discussed previously. In FIG. 17, the latch 132 is shown in an unlocked position with the spring clip 136 in a first position and the locking lever 134 up. Again, this would be the position of the latch 132 when the bowl 104 is placed on or removed from the connection platform 106. When the bowl 104 is placed on the connection platform 106, hook 159 lowers into opening 138—where there is sufficient clearance for easy mating. Once the bowl 104 is in place, the lever 134 is pushed down as depicted in FIG. 18. Movement of the lever in this manner translates the motion along the spring clip 136, pulling it toward the latch hook 159 and thereby engaging it.

Figure 19:
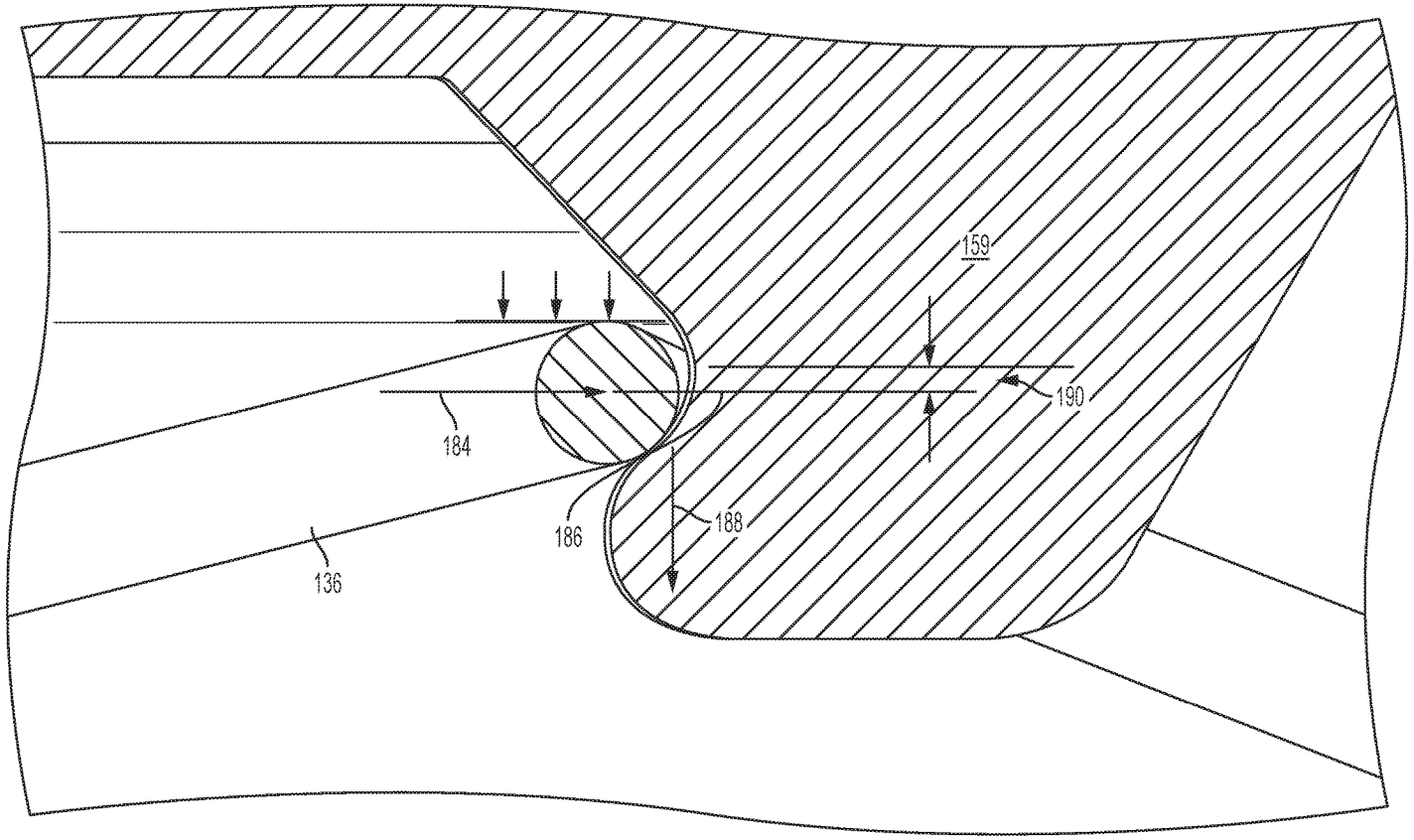
FIG. 19 is a side-sectional view of a latch hook and spring clip according to one embodiment of the present invention illustrating the relative movement of the spring clip during locking motion.

In certain embodiments, the latching action also creates a downward force sufficient to compress the bumpers or compression pads 130. In FIG. 19, this downward force is depicted at 188. The downward force 188 is similar to the downward compression force 178 discussed previously in connection with FIG. 16. Specifically, as seen in this illustration, as latch 132 is locked, spring clip 136 is pulled toward locking lever 134 along vector 184. As spring clip 136 slides along a ramp portion 186 of the hook 159, it exerts a downward directional force on the hook 159 and consequently bowl 104. This downward force is depicted at 188. The downward distance travelled by the bowl 104 in response to this force is depicted at 190. When the latch 132 is unlocked, the release of the spring clip 136 tension would allow the hook 159 and consequently bowl 104 to be moved in the opposite direction for removal.

As discussed above, engagement of the latch hook 159 with the spring clip 136 also acts to engage the other hooks 160 with the slots 128. Specifically, the pulling motion from the spring clip 136 in engaging the latch hook 159 also pulls the bowl 104 forward which in turn pulls the slot engagement hooks 160 forward and secures them in the slots 128 (about ¼" of forward movement in one embodiment).

Figure 21:
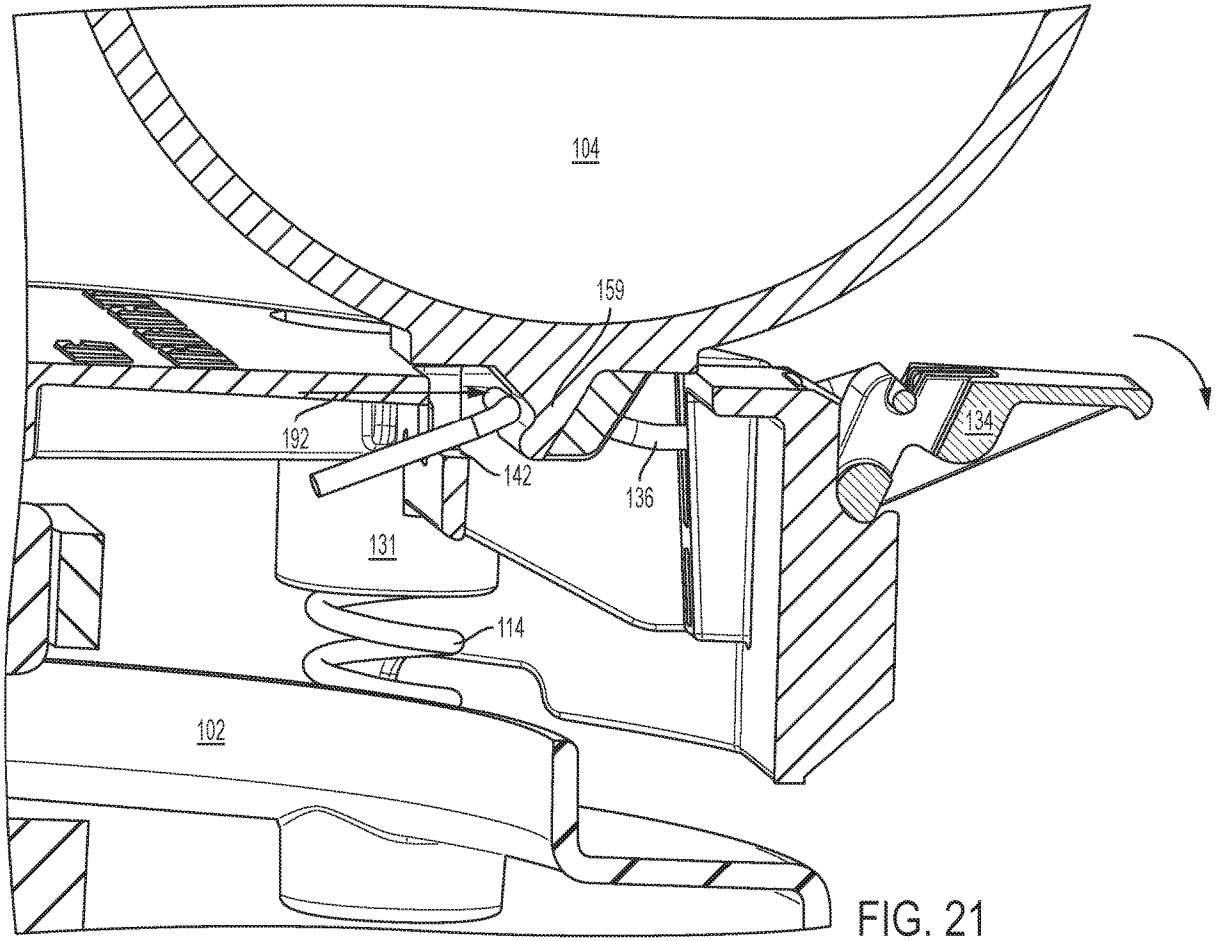
FIG. 21 is a side-sectional view of a locking mechanism according to one embodiment of the present invention illustrating the relative movement of the spring clip as the locking mechanism is changed from an unlocked position to locked position.
Figure 22:
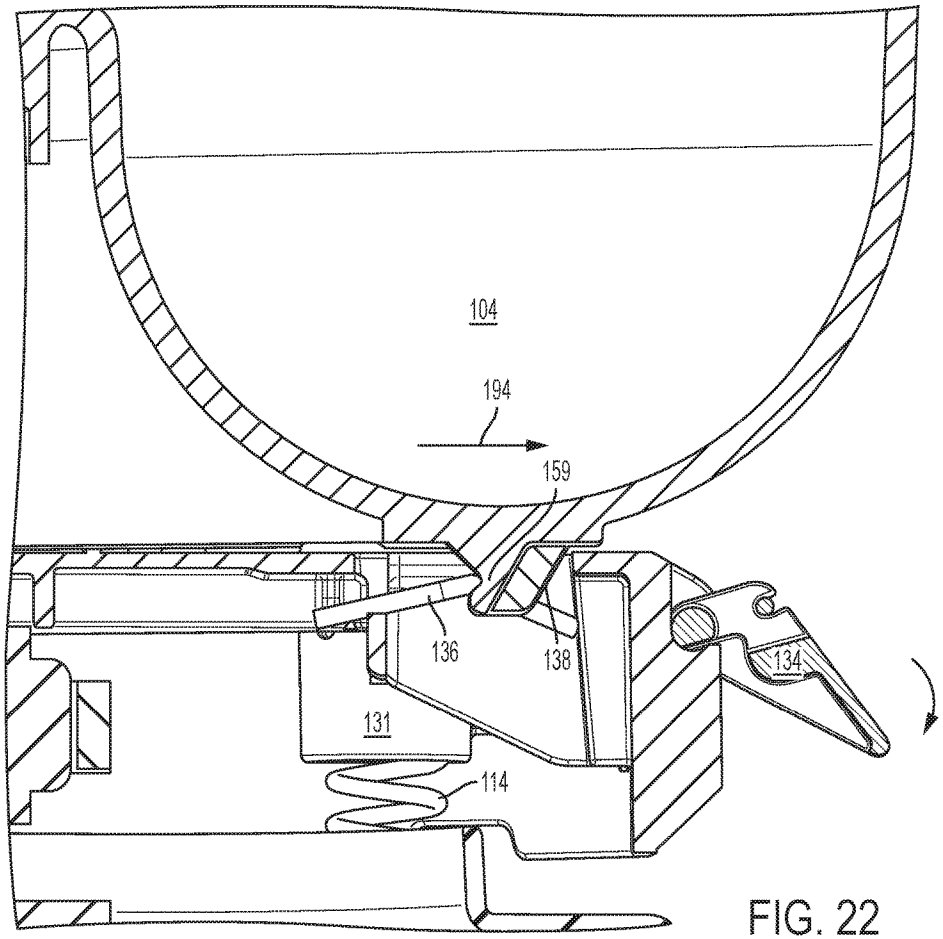
FIG. 22 is a side-sectional view of a locking mechanism according to one embodiment of the present invention illustrating the relative movement of the bowl as the locking mechanism is changed from an unlocked position to locked position.
Figure 23:
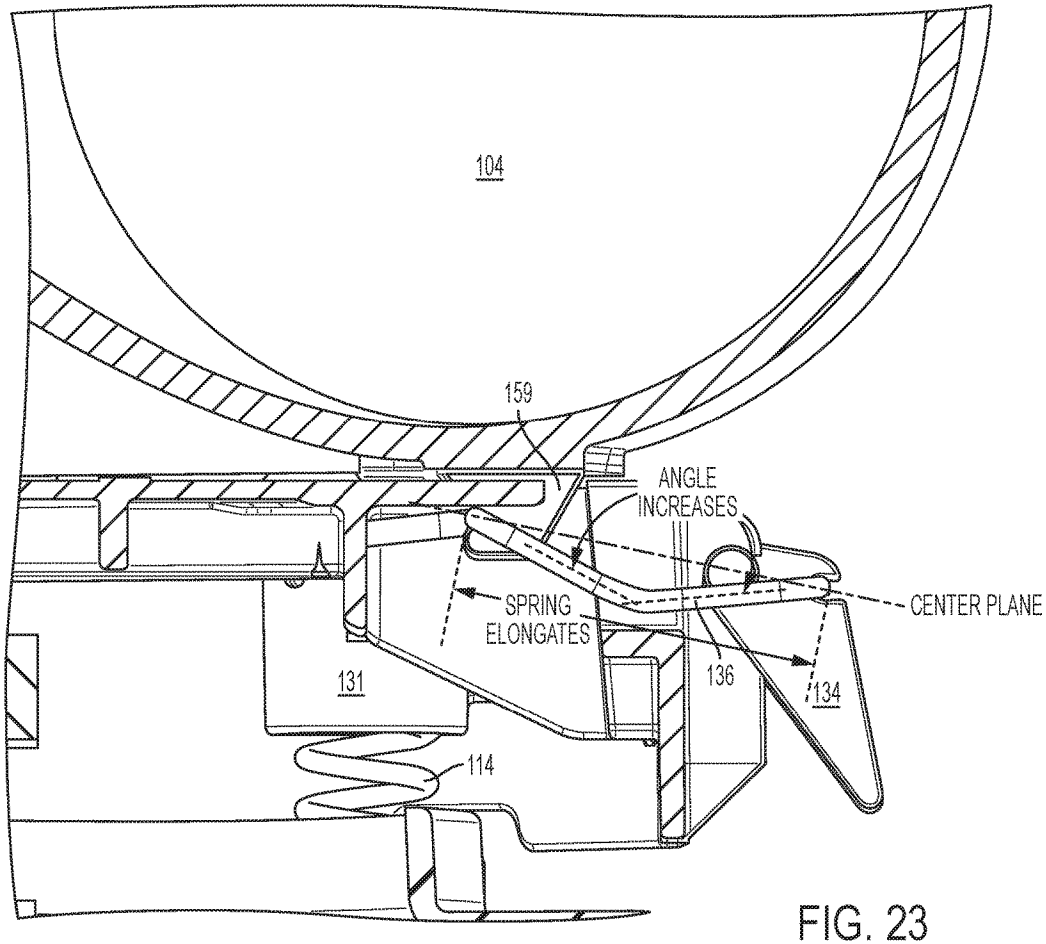
FIG. 23 is a side-sectional view of a locking mechanism according to one embodiment of the present invention illustrating the relative movement of the spring clip as the locking mechanism is changed from an unlocked position to locked position.

FIG. 21 illustrates, according to one embodiment of the present invention, the outward movement 192 of the spring clip 136 when the latch 132 is moved to a locked position. FIG. 22 illustrates, according to one embodiment of the present invention, how the pull of the spring clip 136 translates into outward movement of the bowl (depicted at 194) when the latch 132 is moved to a locked position. FIG. 23 illustrates the elongation of the spring clip 136 as the latch 132 is closed according to one embodiment of the present invention.

Figure 24:
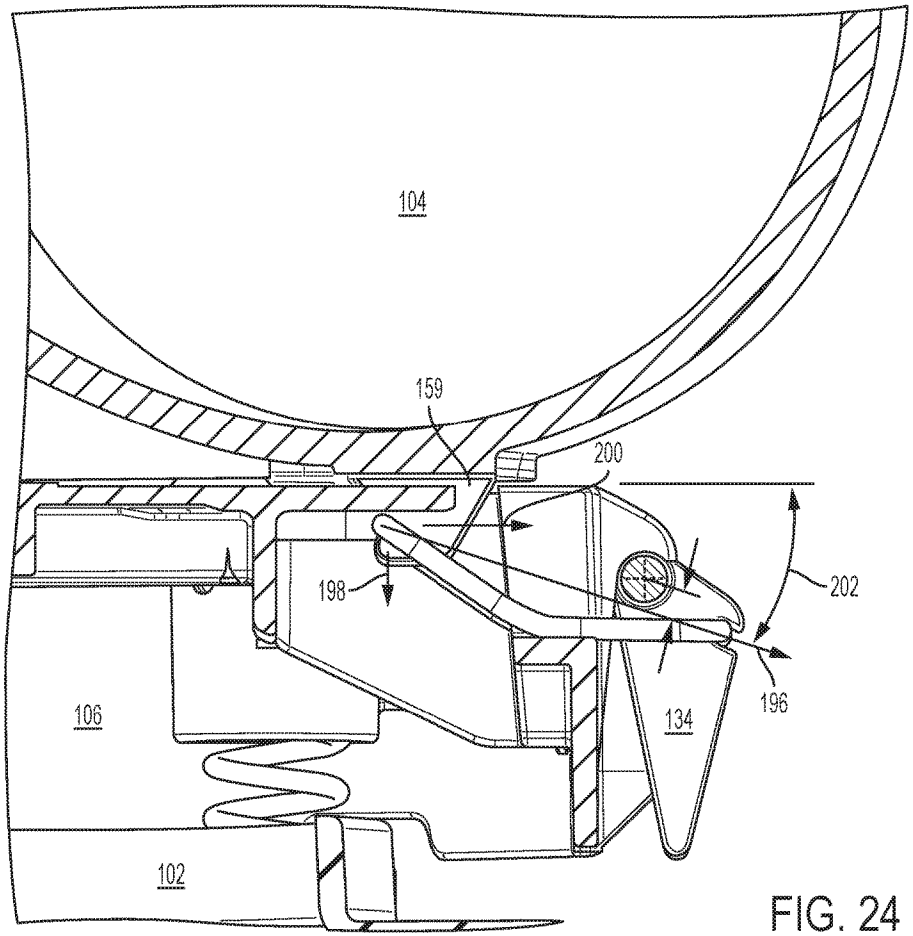
FIG. 24 is a side-sectional view of a locking mechanism according to one embodiment of the present invention illustrating the forces applied along the spring clip as the locking mechanism is changed from an unlocked position to locked position.
Figure 25:
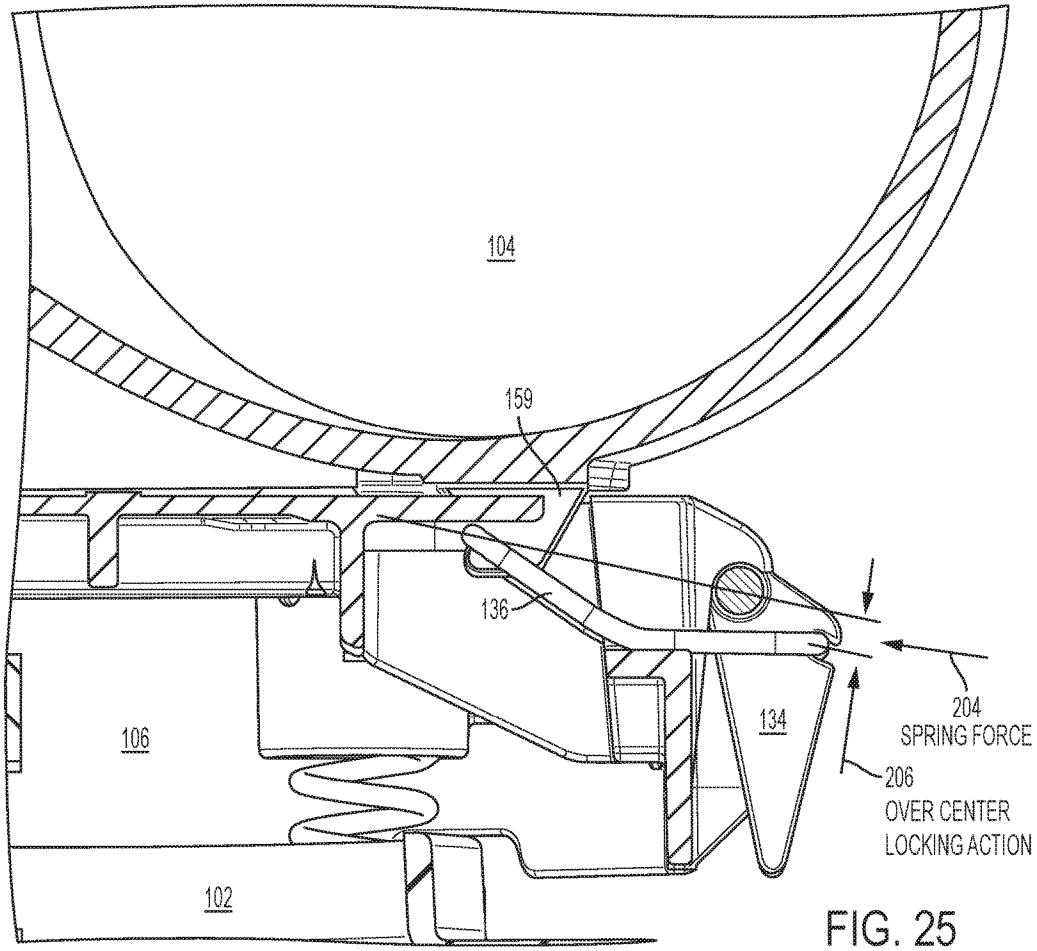
FIG. 25 is a side-sectional view of a locking mechanism according to one embodiment of the present invention illustrating the over center locking action.

FIG. 24 depicts a vector 196 along which a force is directed in locking the latch 132—with the downward directional force depicted at 198 and the horizontal directional force depicted at 200. The angular change 202 of the spring 136 between the open and closed position is also depicted. FIG. 25 depicts the spring force 204 with the latch in a locked position. An over center locking action depicted at 206 helps ensure the latch 132 remains secure when the tumbler 100 is in operation. Specifically, once the lever 134 is rotated down over center, the spring clip 136 retracts slightly, but maintains spring tension on the hook, pulling in a downward vector, thus keeping the bowl 104 firmly engaged with the connection platform 106. Because the tension the spring clip 136 is applying to the lock lever 134 and because the lock lever 134 has passed over center, force would be needed to unlatch the lever 134, thus keeping the bowl 104 firmly locked in place during operation.

In certain embodiments, the lever 134 and spring clip 136 are attached in a way that allows the lever 134 to rotate while the portion of the spring clip 136 that engages with the bowl 104 remains substantially in the same plane. When the lever 134 is up, the spring clip 136 is located further toward the center of the machine leaving plenty of room for the bowl 104 to be removed or installed without interfering with the latch 132. When the lever 134 is pulled down, the spring clip 136 simultaneously pulls the bowl 104 towards it (engaging the hooks 160 with slots 128 as described above) and engages with the latch hook 159, locking the bowl 104 down.

When operation of the tumbler 100 is completed, the locking lever 134 is switched upward. Positioning the lever 134 in an up position translates the motion along the spring clip 136, pushing it away from the latch hook 159 and thereby disengaging it. Once the latch hook 159 becomes disengaged from spring clip 136, the bowl 104 can be removed by simply sliding it away from the latch 132 (about ¼" in one embodiment) to disengage the other hooks 160 from the slots 128. Then the bowl 104 is free to be lifted away from the connection platform 106 which contains the motor 118 and offset weights 120. One additional advantage of the present invention is that separate bowls can be interchangeably used with a single unit. For example, a user might want to have a variety of different polishing media that can be swapped out (e.g. depending on the condition of the casing being polished, how shiny a finish is desired, etc.). The present invention allows users to have separate and interchangeable bowls for the different types of media.

It is noted that the relative maneuvering of the lever between the latched and unlatched position could, in certain embodiments, be reversed. For example, in some instances, it may be desirable to configure the lever and spring clip such that the upward position of the lever is the latched position and the downward position of the lever is the unlatched position.

The spring clip 136 is advantageous in this application as it not only provides the hook and spring function, but also provides a snug mechanical hold-down. Friction also provides just enough resistance in certain embodiments that the lever remains in the up position when the bowl 104 is removed.

Other features of certain embodiments of the present invention that are advantageous include the dome lid 150, as depicted in FIG. 1 through FIG. 4. The dome lid 150, while not necessarily required in all embodiments, allows for quieter operation of the tumbler. In particular, it was discovered that flat lids contribute to the noise level during operation, in two or more ways: 1) As the casings and media circulate in the bowl, some casings rising to the top would rattle on the lid for a short time making a high frequency pecking sound; and 2) the flat lid acted as a speaker, and seemed to amplify the noise caused by the pecking of the casings. The dome shaped lid creates a void above the circulating casings and media, significantly reducing if not eliminating the occurrence of casings pecking on the lid from the inside. The dome shape also eliminates the flat, speaker like surface that amplifies the noise caused by the tumbling action. Additionally, the dome lid is less prone to bending and breakage.

The base geometry of certain embodiments of the present invention is also advantageous in that it provides more stability. Thus, it is quieter and less likely to walk which also lends itself to the longevity of the device.

Figure 20:
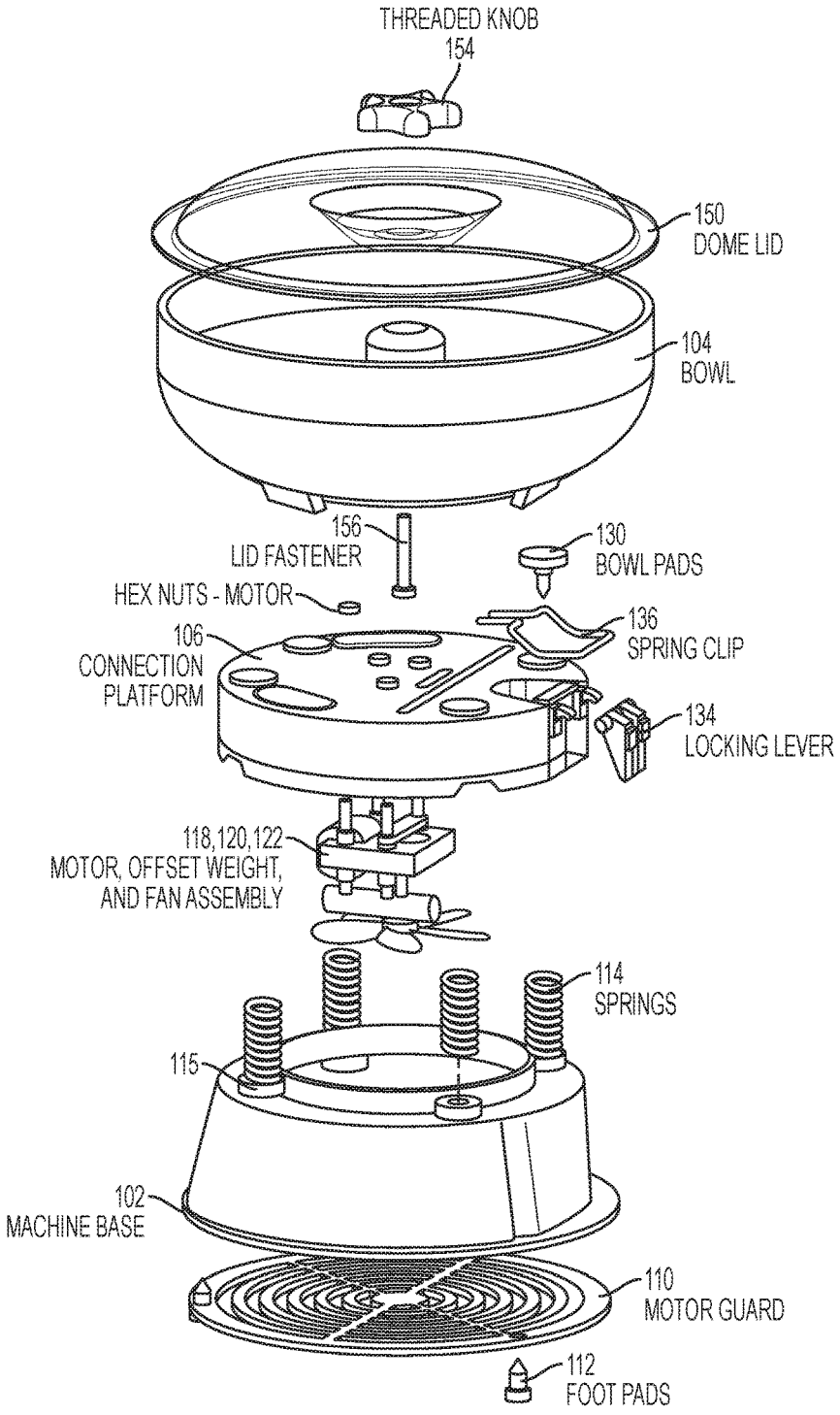
FIG. 20 is an assembly diagram of a vibratory tumbler according to one embodiment of the present invention.

According to one embodiment, an assembly diagram of the present invention is depicted in FIG. 20. The vibratory tumbler 100 in this embodiment includes a bowl 104 that is removably coupled to a connection platform 106—which includes the vibration source. Connection platform 106 is in turn coupled to base 102 with one or more springs 114. In this embodiment, springs 114 are secured to base 102 at openings 115. The springs 114 isolate the vibrating motion of the connection platform 106 (and consequently the bowl 104) from the base 102. If the base 102 were to vibrate, the tumbler 100 would not sit stationary on the work surface. Corresponding openings 131 are included in connection platform 106 (see, e.g. FIG. 21).

Base 102 in this embodiment includes a motor guard 110 and one or more foot pads 112. Connectors such as bolts or screws can be used to secure the motor 118, offset weights 120 and fan assembly 122 to connection platform 106 at apertures 126.

Materials

Numerous materials as would be apparent to one skilled in the art could be utilized in connection with the present invention and are considered to be within the scope of the present invention. For example, bowls can be made of numerous materials including, but not limited to plastic, fiberglass, metal, wood or combinations thereof. Hooks can be made of numerous materials including, but not limited to plastic, fiberglass, metal, wood or combinations thereof. Hooks can be molded singly with the bowl or separately affixed by affixing mechanisms as would be apparent to one skilled in the art including but not limited to adhesives and plastic welds. In certain embodiments, the hooks and bowl can be made of differing materials. The spring clips are typically made of metal; but could be other materials as would be apparent to one skilled in the art.

Variations

In certain embodiments, it may be desirable to reverse in whole or in part the relative positioning of the hooks, latch levers and spring clips. In particular, in one embodiment, the latching hooks are on the connection platform and the latch and spring clip are positioned on the bowl. In yet other embodiments, the engagement hooks are mated into the connection platform and the slots are on the bowl which is turned to lock them into place. In other embodiments, cam locks and dovetail locks are used instead of the hook and slot configuration. In some embodiments, the connection platform may also include multiple latches and slots.

What is claimed is:

1. A vibratory tumbler comprising:

a) a bowl having one or more engagement hooks and a latching hook;

b) a base;

c) a connection platform coupled to the base and removably coupled to the bowl, wherein the connection platform further comprises:

a vibration source;

one or more openings capable of engaging the one or more engagement hooks; and a locking mechanism capable of engaging the latching hook, wherein the locking mechanism further comprises a latching opening capable of receiving the latching hook; a spring clip substantially within the latching opening and capable of engaging the latching hook; and a locking lever rotatably coupled to the spring clip whereby the spring clip engages the latching hook when the locking lever is in a locked position and releases the latching hook when the locking lever is in an unlocked position.

2. The vibratory tumbler of claim 1, wherein the engagement hooks and latching hook are substantially the same.

3. The vibratory tumbler of claim 1, wherein the engagement hooks are notched.

4. The vibratory tumbler of claim 1, wherein the latching hook is notched.

5. The vibratory tumbler of claim 1, wherein the bowl includes a lid.

6. The vibratory tumbler of claim 5, wherein the lid is dome shaped.

7. The vibratory tumbler of claim 1, wherein the connection platform further includes one or more compression pads.

8. The vibratory tumbler of claim 1, wherein the connection platform is coupled to the base with one or more springs.

9. The vibratory tumbler of claim 1, wherein the connection platform and the base are a single unit.

10. The vibratory tumbler of claim 1, wherein the bowl is substantially annular in shape.

11. The vibratory tumbler of claim 1, wherein the one or more engagement hooks and the latching hook are substantially uniformly spaced apart.

12. A vibratory tumbler comprising:

a) a bowl having one or more engagement hooks and a latching hook; and b) a connection platform removably coupled to the bowl, wherein the connection platform further comprises:

a vibration source;

one or more openings capable of engaging the one or more engagement hooks; and a locking mechanism capable of engaging the latching hook, wherein the locking mechanism further comprises a latching opening capable of receiving the latching hook; a spring clip capable of engaging the latching hook; and a locking lever rotatably coupled to the spring clip whereby the spring clip engages the latching hook when the locking lever is in a locked position and releases the latching hook when the locking lever is in an unlocked position.

13. The vibratory tumbler of claim 12 wherein the connection platform is coupled to a base.

14. The vibratory tumbler of claim 13, wherein the connection platform is coupled to the base with one or more springs.

15. The vibratory tumbler of claim 12, wherein the engagement hooks and latching hook are substantially the same.

16. The vibratory tumbler of claim 12, wherein the bowl includes a lid.

17. The vibratory tumbler of claim 16, wherein the lid is dome shaped.

18. The vibratory tumbler of claim 12, wherein the connection platform further includes one or more compression pads.

19. The vibratory tumbler of claim 12, wherein the one or more engagement hooks and the latching hook are substantially uniformly spaced apart.

* * * * *